US010520861B2

(12) United States Patent
Kakomura et al.

(10) Patent No.: US 10,520,861 B2
(45) Date of Patent: Dec. 31, 2019

(54) IMAGE FORMING APPARATUSES EMPLOYING AN ELECTROPHOTOGRAPHIC METHOD

(71) Applicant: CANON KABUSHIKI KAISHA, Tokyo (JP)

(72) Inventors: Kiyoharu Kakomura, Nagareyama (JP); Noriaki Matsui, Kashiwa (JP); Yuya Ohta, Abiko (JP); Takayuki Inoue, Matsudo (JP); Nozomi Kumakura, Matsudo (JP); Naoka Omura, Matsudo (JP); Junichiro Nakabayashi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/243,633

(22) Filed: Jan. 9, 2019

(65) Prior Publication Data

US 2019/0146380 A1 May 16, 2019

Related U.S. Application Data

(63) Continuation of application No. PCT/JP2017/024596, filed on Jul. 5, 2017.

(30) Foreign Application Priority Data

Jul. 13, 2016 (JP) ..... 2016-138747

(51) Int. Cl.

| | |
|---|---|
| ***G03G 15/16*** | (2006.01) |
| ***G03G 15/04*** | (2006.01) |
| ***G03G 15/08*** | (2006.01) |
| ***G03G 15/01*** | (2006.01) |
| ***G03G 21/14*** | (2006.01) |
| ***G03G 15/00*** | (2006.01) |

(52) U.S. Cl.

CPC ..... *G03G 15/161* (2013.01); *G03G 15/01* (2013.01); *G03G 15/04072* (2013.01); *G03G 15/0806* (2013.01); *G03G 15/16* (2013.01); *G03G 15/6508* (2013.01); *G03G 21/14* (2013.01); *G03G 2215/00725* (2013.01)

(58) Field of Classification Search

CPC ..... G03G 2215/00725

See application file for complete search history.

(56) References Cited

U.S. PATENT DOCUMENTS 5,289,236 A 2/1994 Yoshino

FOREIGN PATENT DOCUMENTS

JP 7-121080 A 5/1995
JP 2006267306 A * 10/2006

(Continued)

*Primary Examiner* — Victor Verbitsky

(74) *Attorney, Agent, or Firm* — Canon USA, Inc., IP Division

(57) ABSTRACT

An image forming apparatus (10) is capable of continuing, when detecting running out of sheet in a cassette (130*a*) during image formation, the image formation by performing switching to another cassette (130*b*). When it is determined that sheets are run out based on a signal supplied from a sheet sensor (131*a*) of a cassette being used after exposure is started based on image data of a certain page, cleaning is performed on a secondary transfer roller (106) and exposure is started based on the image data of a target page before the cleaning is terminated.

9 Claims, 15 Drawing Sheets

(56) References Cited

FOREIGN PATENT DOCUMENTS

| | | | |
|---|---|---|---|
| JP | 2008-191214 | A | 8/2008 |
| JP | 2009-286577 | A | 12/2009 |
| JP | 2015-219472 | A | 12/2015 |

* cited by examiner

FIG. 10

| PAGE NUMBER | PAGE PROCESSING STATE | CASSETTE NUMBER |
|---|---|---|
| | NOT GENERATED/<br>GENERATED/<br>COMPLETION OF SHEET FEEDING/<br>COMPLETION | a/b/c/d/NOTHING |

FIG. 11A

| PAGE NUMBER | PAGE PROCESSING STATE | CASSETTE NUMBER |
|---|---|---|
| 1 | NOT GENERATED | a |
| 2 | NOT GENERATED | a |

FIG. 11B

| PAGE NUMBER | PAGE PROCESSING STATE | CASSETTE NUMBER |
|---|---|---|
| 1 | NOT GENERATED → GENERATED | a |
| 2 | NOT GENERATED | a |

FIG. 11C

| PAGE NUMBER | PAGE PROCESSING STATE | CASSETTE NUMBER |
|---|---|---|
| 1 | GENERATED → SHEET FEEDING COMPLETION | a |
| 2 | NOT GENERATED | a |

FIG. 11D

| PAGE NUMBER | PAGE PROCESSING STATE | CASSETTE NUMBER |
|---|---|---|
| 1 | SHEET FEEDING COMPLETION | a |
| 2 | NOT GENERATED → GENERATED | a |

FIG. 11E

| PAGE NUMBER | PAGE PROCESSING STATE | CASSETTE NUMBER |
|---|---|---|
| 1 | SHEET FEEDING COMPLETION | a |
| 2 | GENERATED → NOT GENERATED | a → b |

FIG. 11F

| PAGE NUMBER | PAGE PROCESSING STATE | CASSETTE NUMBER |
|---|---|---|
| 1 | SHEET FEEDING COMPLETION | a |
| 2 | NOT GENERATED → GENERATED | b |

FIG. 11G

| PAGE NUMBER | PAGE PROCESSING STATE | CASSETTE NUMBER |
|---|---|---|
| 1 | SHEET FEEDING COMPLETION | a |
| 2 | GENERATED → SHEET FEEDING COMPLETION | b |

FIG. 11H

| PAGE NUMBER | PAGE PROCESSING STATE | CASSETTE NUMBER |
|---|---|---|
| 1 | SHEET FEEDING COMPLETION → COMPLETION | a |
| 2 | SHEET FEEDING COMPLETION | b |

FIG. 11I

| PAGE NUMBER | PAGE PROCESSING STATE | CASSETTE NUMBER |
|---|---|---|
| 1 | COMPLETION | a |
| 2 | SHEET FEEDING COMPLETION → COMPLETION | b |

FIG. 12

| PAGE NUMBER | CASSETTE | IMAGE FORMING | |
|---|---|---|---|
| | a/b/c/d | START TIME POINT | COMPLETION TIME POINT |
| | | REFERENCE TIME POINT +A | START TIME POINT +PAGE SIZE TIME |
| | | SHEET FEEDING | |
| | | START TIME POINT | COMPLETION TIME POINT |
| | | REFERENCE TIME POINT +B | START TIME POINT +PAGE SIZE TIME |
| | | TRANSFER | |
| | | START TIME POINT | COMPLETION TIME POINT |
| | | REFERENCE TIME POINT +C | START TIME POINT +PAGE SIZE TIME |

IMAGE FORMING APPARATUSES EMPLOYING AN ELECTROPHOTOGRAPHIC METHOD

CROSS-REFERENCE TO RELATED APPLICATIONS

This application is a Continuation of International Patent Application No. PCT/JP2017/024596, filed Jul. 5, 2017, which claims the benefit of Japanese Patent Application No. 2016-138747, filed Jul. 13, 2016, both of which are hereby incorporated by reference herein in their entirety.

TECHNICAL FIELD

The present invention relates to an image forming apparatus.

BACKGROUND ART

A number of image forming apparatuses employing an electrophotographic method include photoconductive drums dedicated for yellow (Y), magenta (M), cyan (C), and black (K) and employ an intermediate transfer method for performing primary transfer of toner images formed on the photoconductive drums on an intermediate transfer belt, and thereafter, performing secondary transfer on a sheet using secondary transfer rollers. Such an image forming apparatus requires a long period of time from exposure to the secondary transfer by a distance from the photoconductive drums to the secondary transfer rollers since the secondary transfer is performed on a sheet after the primary transfer is performed on the intermediate transfer belt. Therefore, when an image forming operation is executed, the exposure may be started first before sheet feeding is started depending on a position of a cassette. Such an operation of starting an image forming operation before a sheet feeding operation is referred to as an "image-forming-first method". On the other hand, an operation of starting the sheet feeding operation before the image forming operation is referred to as a "sheet-feeding-first method".

Here, in a case where images are successively formed on a plurality of sheets, sheets may run out (paper out). In this case, the image forming apparatus has a function of continuously performing the image forming operation even after paper out occurs by automatically performing switching to another cassette accommodating the same type of sheets instead of stop of the image forming as a no-sheet error. This function is referred to as "auto cassette change (ACC)". A method for performing switching of a cassette by the auto cassette change is disclosed in PTL 1.

In a case where the image forming apparatus which performs an image forming operation in the image-forming-first method performs the auto cassette change, image formation may have already been started when no sheet in a cassette is detected although depending on a timing when no sheet is detected. In this case, the general image forming apparatuses execute cleaning of toners which are formed on the photoconductive drums first and transferred on the intermediate transfer belt and execute image formation of the same page again after the cleaning.

CITATION LIST

Patent Literature

PTL 1 Japanese Patent Laid-Open No. 2009-286577

In a case where no sheet is detected after the image formation as described above, such a general image forming apparatus performs the image forming operation of the same page from the beginning after a cleaning operation is performed first. However, the image formation of the same page is restarted at a timing when all sheets conveyed in the image forming apparatus are discharged out of the apparatus.

The image forming apparatus which performs the auto cassette change according to the present invention provides means for quickly restarting the image forming operation when no sheet is detected after the image formation is started.

SUMMARY OF INVENTION

According to an aspect of the present invention, an image forming apparatus includes a first photoreceptor, first exposure means configured to expose the first photoreceptor so as to form an electrostatic latent image on the first photoreceptor, first developing means configured to develop the electrostatic latent image formed on the first photoreceptor as a toner image, a second photoreceptor, second exposure means configured to expose the second photoreceptor so as to form an electrostatic latent image on the second photoreceptor, second developing means configured to develop the electrostatic latent image formed on the second photoreceptor as a toner image, an intermediate transfer belt onto which the toner image formed on the first photoreceptor and the toner image formed on the second photoreceptor are transferred, a secondary transfer roller configured to transfer the toner image on the intermediate transfer belt onto a sheet, a plurality of cassettes configured to accommodate sheets, detection means configured to detect a sheet and provided for individual cassettes, and control means configured to continue an image forming job by performing switching to a second cassette which accommodates sheets which are the same as a specified type of sheet accommodated in the first cassette, when it is determined that the first cassette does not accommodate a sheet in accordance with a signal supplied from the detection means provided in the first cassette while the image forming job of forming an image on a sheet supplied from the first cassette is executed. The first photoreceptor is disposed on an upstream side relative to the second photoreceptor in a direction of rotation of the intermediate transfer belt. The control means executes a cleaning process of forming an electric field for cleaning between the intermediate transfer belt and the secondary transfer roller when determining that a sheet to which a toner image of image data is to be transferred is not accommodated in the first cassette after formation of an electrostatic latent image of the data in a certain page is started by the first exposure means, and causes the first exposure means to form the electrostatic latent image of the image data on the same page before the cleaning process is terminated.

Further features of the present invention will become apparent from the following description of exemplary embodiments with reference to the attached drawings.

BRIEF DESCRIPTION OF DRAWINGS

FIG. 10 is a diagram illustrating a configuration of a page list.

FIGS. 11A to 11I are diagrams illustrating transition in a job included in the page list.

FIG. 12 is a diagram illustrating an image forming condition.

DESCRIPTION OF EMBODIMENTS

Hereinafter, an embodiment of the present invention will be described with reference to the accompanying drawings.

Basic Print Operation

Figure 1:
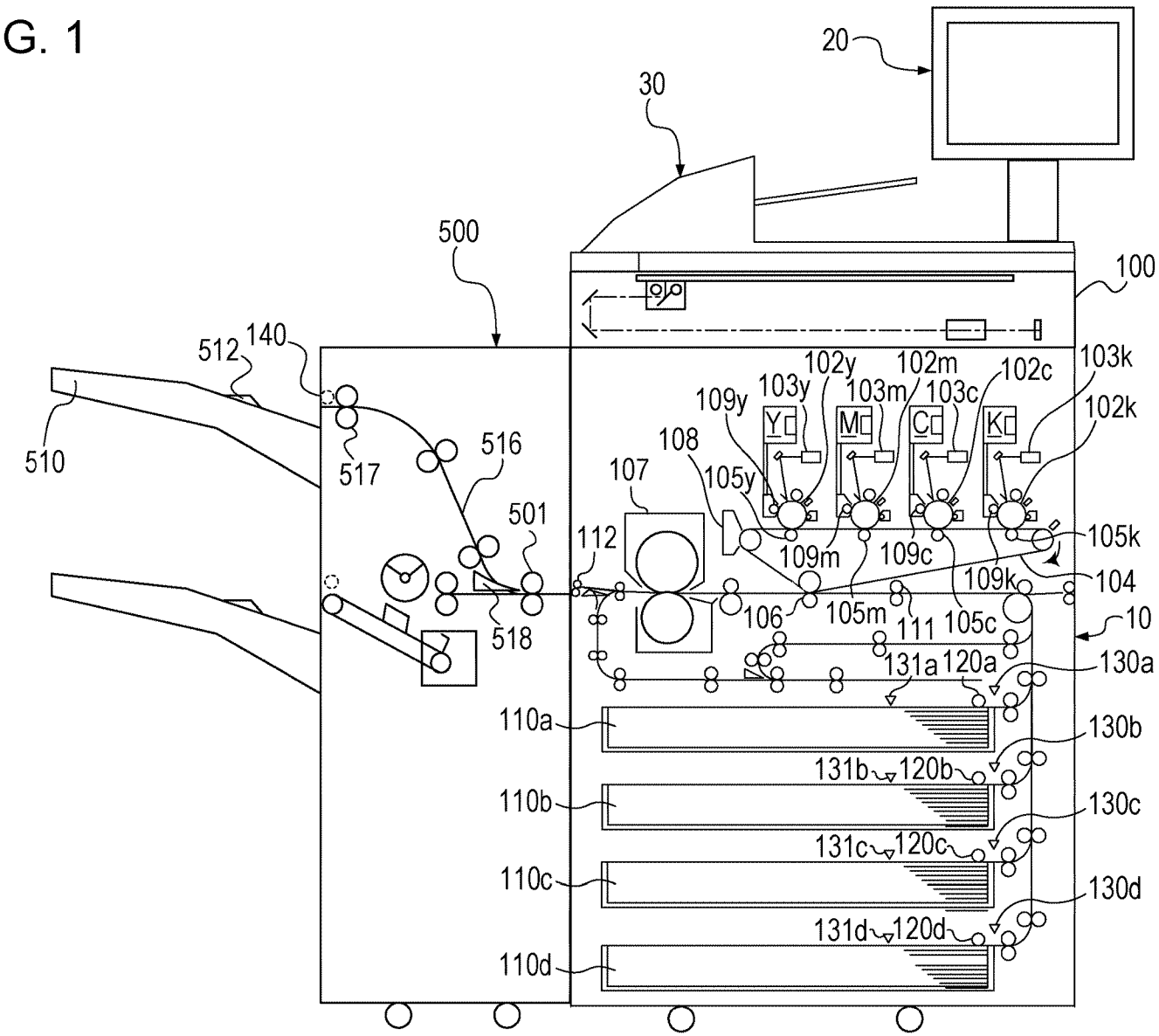
FIG. 1 is a cross-sectional view of an image forming apparatus.

A configuration of an image forming apparatus will be described with reference to FIGS. 1 and 2. FIG. 1 is a cross-sectional view of an image forming apparatus 10 employing an electrophotographic method. The image forming apparatus 10 in this embodiment employs an intermediate transfer method of performing primary transfer of toner images formed on photoconductive drums 102 which are image carriers to an intermediate transfer belt and performing secondary transfer to paper (a sheet) using a secondary transfer roller 106.

The image forming apparatus 10 includes photoconductive drums (image carriers) 102*y*, 102*m*, 102*c*, and 102*k* which are dedicated for yellow (Y), magenta (M), cyan (C), and black (K), respectively. The photoconductive drums 102*y*, 102*m*, 102*c*, and 102*k* are charged by chargers. Exposure controllers 103*y*, 103*m*, 103*c*, and 103*k*, which serve as exposure means, convert image data of a target page of an image forming job into laser driving signals. The exposure controllers 103 emit laser light to the respective photoconductive drums 102 based on the laser driving signals so as to form electrostatic latent images. The electrostatic latent images formed on the photoconductive drums 102*y*, 102*m*, 102*c*, and 102*k* are developed using a developing agent by developing units 109*y*, 109*m*, 109*c*, and 109*k* so that toner images of the individual colors are formed on the photoconductive drums 102.

The image forming apparatus 10 includes an intermediate transfer belt (ITB) 104 in a position adjacent to the photoconductive drums 102*y*, 102*m*, 102*c*, and 102*k*. It is assumed in this embodiment that the photoconductive drum 102*y* serves as a photoconductive body on an upstream side relative to a rotation direction of the ITB 104, and the photoconductive drum 102*k* serves as a photoconductive body on a downstream side relative to the rotation direction of the ITB 104. Image formation on a photoconductive body arranged on an upstream side is started before image formation on a photoconductive body arranged on a downstream side is started.

The toner images of the individual colors formed on the photoconductive drums 102*y*, 102*m*, 102*c*, and 102*k* are transferred on the ITB 104 using primary transfer rollers 105*y*, 105*m*, 105*c*, and 105*k* (primary transfer). A toner image on the ITB 104 is transferred on a sheet by the secondary transfer roller 106 (secondary transfer). The sheet including the toner image transferred thereon is heated and pressed by a fixing unit 107 so that the image is fixed on the sheet. The sheet which has passed the fixing unit 107 is conveyed to a finisher 500 which performs post-processing and which discharges the sheet to an outside of the apparatus. The finisher 500 is a post-processing apparatus which executes post-processing including a binding process of binding a bundle of sheets using staples, a punching process of forming a punch hole on sheets, a bookbinding process.

Next, an operation of an image forming job performed by the image forming apparatus 10 will be described. When receiving an image forming job from an operation unit 20 or an external apparatus not illustrated, the image forming apparatus 10 instructs a reader unit 100 to read a document so as to generate image data. Thereafter, the image forming apparatus 10 corrects the image data based on a gradation table generated in accordance with an engine characteristic. The image data (a video signal) is input to the exposure controllers 103 so as to be converted into a laser driving signal. The exposure controllers 103 emit laser light to the photoconductive drums 102 based on the laser driving signals. By this, electrostatic latent images are formed on the photoconductive drums 102. The electrostatic latent images on the photoconductive drums 102 are developed by the developing units 109. The toner images formed on the photoconductive drums 102 are primarily transferred onto the ITB 104 at respective predetermined timings, and color components are superposed on one another so that a desired color image is formed. Note that a series of operations from the exposure to the primary transfer is referred to as an "image forming operation" hereinafter.

On the other hand, a load driving unit 625 drives one of sheet feeding motors 626*a* to 626*d* so that a sheet accommodated in a corresponding one of cassettes 110*a* to 110*d* which are sheet accommodation units is fed by a corresponding one of sheet feeding rollers 120*a* to 120*d*. Then a corresponding one of sheet feeding sensors 130*a* to 130*d* determines whether sheet feeding is completed. When the sheet feeding is completed, a corresponding one of sheet sensors 131*a* to 131*d* determines presence or absence of a sheet in the corresponding one of the cassettes (the sheet accommodation units) 110*a* to 110*d*. A central processing unit (CPU) 621 determines that the cassette 110 does not accommodate any sheet in accordance with a detection signal output from the corresponding one of the sheet sensors 131. Hereinafter, an operation of feeding a sheet from the cassettes 110*a* to 110*d* which are the sheet accommodation units is referred to as a "sheet feeding operation".

After the sheet is fed, the load driving unit 625 drives a conveying motor 170 so that the sheet is conveyed to a registration roller 111. When a leading end of the sheet has reached the registration roller 111, the load driving unit 625 drives the registration roller 111 at an arbitrary timing so that the sheet is conveyed to a position between the ITB 104 and the secondary transfer roller 106 in accordance with the toner images transferred on the ITB 104 by the image forming operation.

The secondary transfer roller 106 secondarily transfers the toner image which has been subjected to the primary transfer to the ITB 104 onto the sheet. Hereinafter, a series of operations of secondarily transferring the toner image on the ITB 104 to the sheet is referred to as a "transfer operation". After the toner image on the ITB 104 is secondarily transferred to the sheet, toner which remains on the ITB 104 is removed by an ITB cleaning unit 108. In this embodiment, the ITB cleaning unit 108 scratches the remaining toner with a blade.

The fixing unit 107 heats and presses unfixed toner which has been transferred onto the sheet so that the toner image is fixed on the sheet. The load driving unit 625 drives the conveying motor 170 so that the sheet on which the toner is fixed is discharged to the finisher 500 through a sheet discharge roller 112. Here, the sheet is discharged in a face-up state. In the finisher 500, a flapper 518 is switched so that the sheet is discharged through a non-sort path 516 to a stack tray 510 by a conveying roller 517. The sheet discharged from the finisher 500 is detected by a sheet discharge sensor 140.

Note that, although the image forming apparatus 10 in FIG. 1 is connected to the finisher 500 serving as the post-processing apparatus, an image forming apparatus which is not connected to such a post-processing apparatus may be employed.

Image-Forming-First Method and Sheet-Feeding-First Method

The image-forming-first method and the sheet-feeding-first method will now be described. Since the image forming apparatus 10 of this embodiment employs the intermediate transfer method, a period of time from the exposure to the secondary transfer corresponding to a distance from the photoconductive drum 102*y* to the secondary transfer roller 106 is required. Therefore, when a sheet is fed from the cassette 110*a* or the cassette 110*b* in the image forming operation, the exposure is started before the sheet feeding operation so that productivity is enhanced. The operation in which the exposure is started first is referred to as the "image-forming-first method" and the operation in which the sheet feeding is started first is referred to as the "sheet-feeding-first method". In the image forming apparatus 10 of this embodiment, a case where a sheet is fed from the cassette 110*a* or the cassette 110*b* corresponds to the image-forming-first method and a case where a sheet is fed from the cassette 110*c* or the cassette 110*d* corresponds to the sheet-feeding-first method.

Auto Cassette Change

The auto cassette change will now be described. In a case where image formation is consecutively performed on a plurality of sheets, sheets may be run out in a cassette being used during an image forming operation, that is, running out of sheet may occur. When sheets are run out during the operation, the image forming apparatus 10 of this embodiment does not stop the image forming operation as a no-sheet error but the image forming apparatus 10 continues the image forming operation by automatically performing switching to another cassette which accommodates the same type of sheet. This function is referred to as "Auto Cassette Change (ACC)".

Cleaning of Secondary Transfer Roller 106

Next, cleaning control on the secondary transfer roller 106 will be described. In a case where an image forming operation is performed in the image-forming-first method, the running out of sheet in a cassette may be detected after formation of electrostatic latent images on the photoconductive drums 102 is started. In this case, the image formation (exposure, charge, and first transfer) has been started, and therefore, a sheet is not conveyed but a toner image on the ITB 104 passes the secondary transfer roller 106. The image forming apparatus 10 of this embodiment is configured such that the ITB 104 and the secondary transfer roller 106 are not separated from each other, and therefore, when the toner image on the ITB 104 has passed the secondary transfer roller 106, part of the toner is attached to the secondary transfer roller 106. Accordingly, toner contamination occurs. Therefore, the secondary transfer roller 106 is cleaned so that contamination of a back surface of a sheet due to the toner contamination of the secondary transfer roller 106 is prevented. Specifically, a transfer controller 635 forms an electric field for performing the cleaning on the secondary transfer roller 106. For example, when a toner image is transferred to a sheet, a transfer bias (DC minus) which has a reversed polarity relative to a secondary transfer bias (DC plus) is applied to the secondary transfer roller (a secondary transfer outer roller) 106. Alternatively, secondary transfer cleaning biases (DC plus and DC minus) are alternately applied to the secondary transfer roller 106. In this way, by applying the transfer voltage for the cleaning, the toner attached to the secondary transfer roller 106 is transferred to the ITB 104 and collected by the ITB cleaning unit 108. A period of time required for the cleaning of the secondary transfer roller 106 is approximately 600 msec in this embodiment and is longer than a sheet interval in a normal secondary transfer operation.

Although the secondary transfer roller 106 is cleaned by changing a secondary transfer voltage in this embodiment, the secondary transfer roller may be cleaned by another method. For example, the remaining toner on the secondary transfer roller may be discharged to a collecting toner buffer. In the case of this configuration, two fur brush rollers which are in contact with the secondary transfer external roller, a bias roller, and a blade are provided. After the remaining toner on the secondary transfer roller 106 is attached to the fur brush rollers and the bias roller, the toner is scratched away by the blade. If this configuration is employed, an electric field for controlling the cleaning of the secondary transfer roller 106 may be formed when no-sheet is detected after the image formation is started.

Block Diagram of Image Forming Apparatus 10

Figure 2:
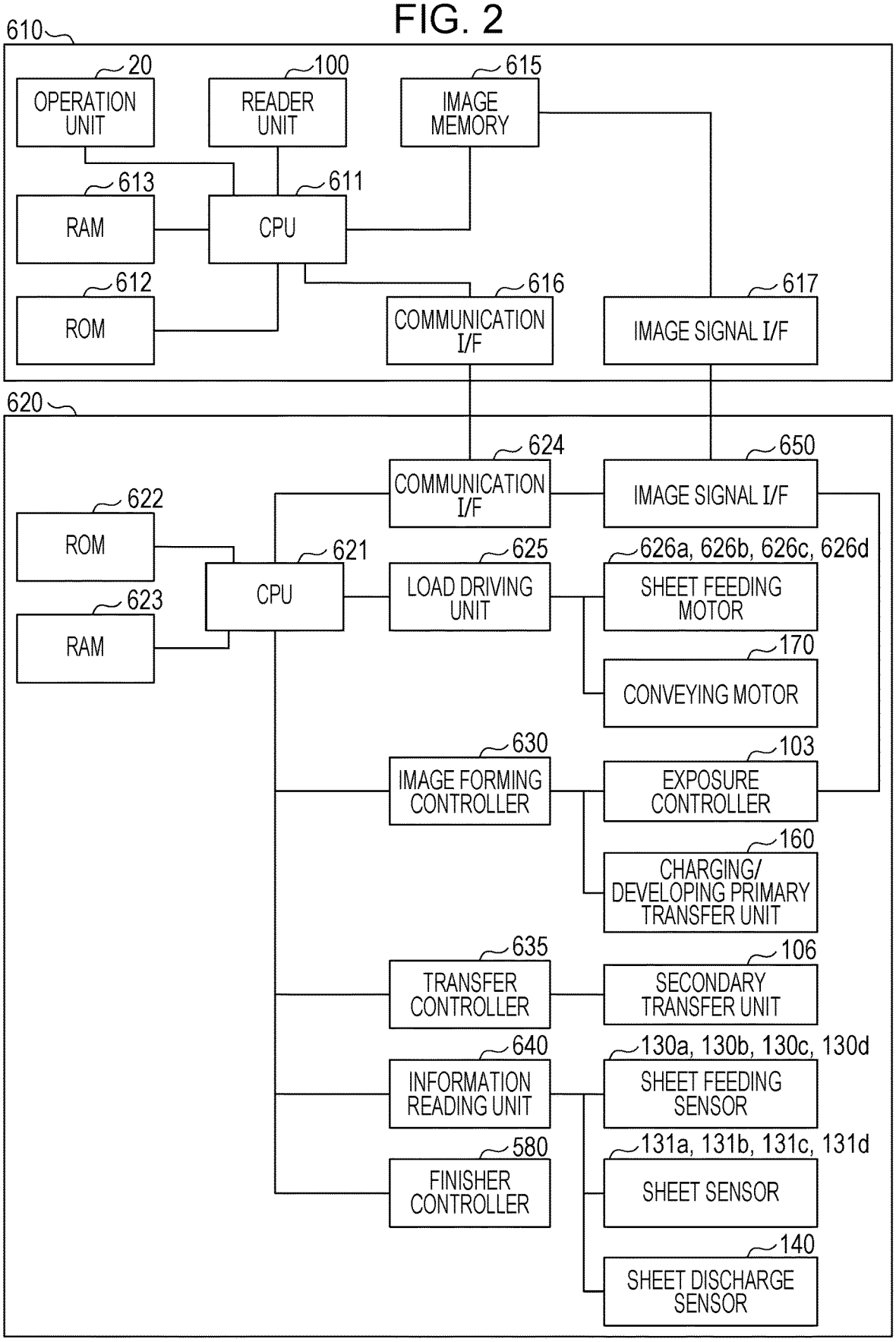
FIG. 2 is a block diagram illustrating the image forming apparatus.

FIG. 2 is a block diagram illustrating the image forming apparatus 10. The image forming apparatus 10 mainly includes an image processor 610 and an image forming unit 620. A CPU 611 included in the image processor 610 executes various processes in accordance with programs stored in a read only memory (ROM) 612. The CPU 611 is an example of first control means. A random access memory (RAM) 613 is used as a work area when the programs are operated. When receiving a copy instruction through the operation unit 20, the CPU 611 causes the reader unit 100 to read a document and stores image data generated from the read document in an image memory 615. Thereafter, the CPU 611 performs image processing on the image data stored in the image memory 615 based on a gradation table stored in the RAM 613 and stores the processed image data as an image signal in another region of the image memory 615.

The CPU 621 included in the image processor 620 executes various processes in accordance with programs stored in a ROM 622. The CPU 621 is an example of second control means. A RAM 623 is used as a region which temporarily stores data at a time of program operation. A communication interface 616 included in the image processor 610 and a communication interface 624 included in the image forming unit 620 transmit and receive commands between the CPUs 611 and 621. An image forming controller 630 includes the exposure controllers 103 and a charging/developing/primary transfer unit 160. Image signal interfaces 617 and 650 are connected to each other in a communication available manner, and an image signal developed in the image memory 615 is input to the exposure controllers 103 through the interfaces. The exposure controllers 103 convert the input image signal into a laser driving signal and irradiates the photoconductive drums 102 with laser light based on the laser driving signal. The charging/developing/primary transfer unit 160 develops electrostatic latent images on the photoconductive drums 102 and performs primary transfer on the ITB 104. The load driving unit 625 includes the sheet feeding motors 626*a* to 626*d* and the conveying motor 170 and discharges a sheet to an outside of the image forming apparatus 10. The transfer controller 635 controls transfer high voltage of the secondary transfer roller 106 and secondarily transfers a toner image on the ITB 104 onto a sheet. Furthermore, the transfer controller 635 brings the transfer high voltage of the secondary transfer roller 106 into a reversed bias or a positive bias, transfers toner attached to the secondary transfer roller 106 to the ITB 104 again so as to perform cleaning on the secondary transfer roller 106. An information reading unit 640 reads detection signals from the sheet feeding sensors 130*a* to 130*d*, the sheet sensors 131*a* to 131*d*, and the sheet discharge sensor 140. A finisher controller 580 performs control of discharge of a discharged sheet to the stack tray 510.

Timing Chart for Comparison Between General Example and Embodiment

Figure 3A:
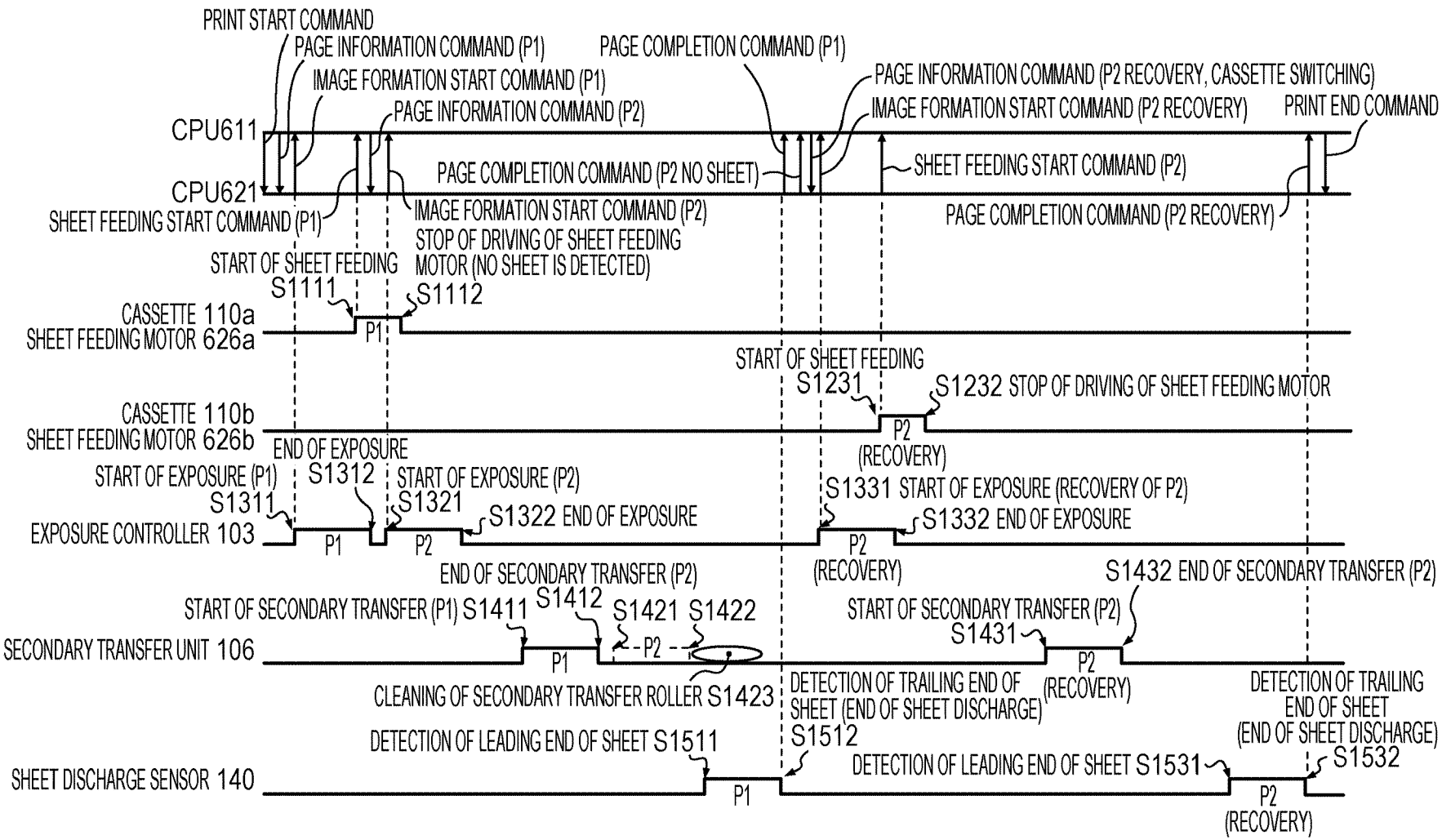
FIG. 3A is a timing chart for comparison between a general example and an embodiment.
Figure 3B:
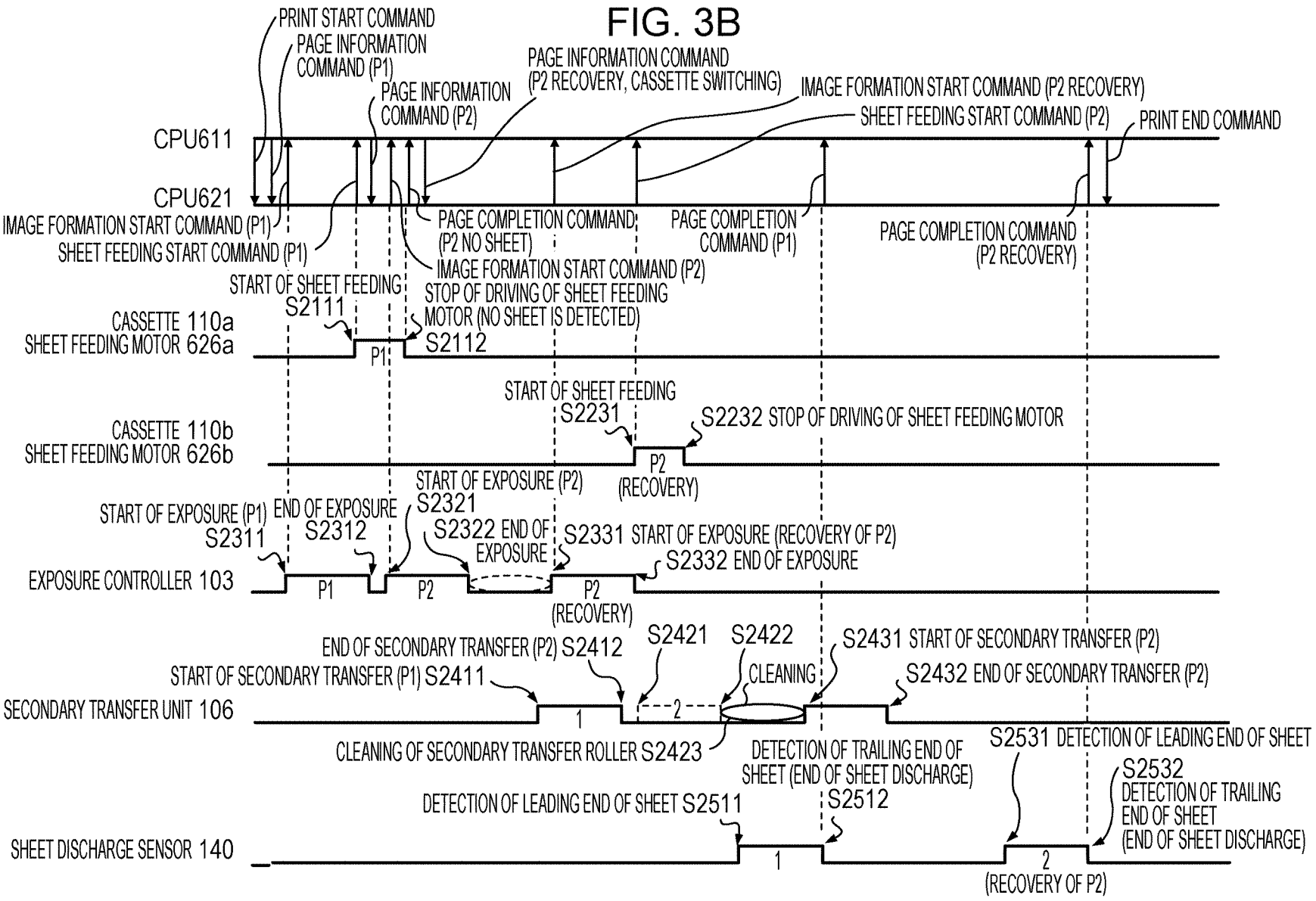
FIG. 3B is a timing chart for the comparison between the general example and this embodiment.

FIGS. 3A and 3B are diagrams illustrating examples of the auto cassette change (hereinafter referred to as "ACC"). It is assumed in the examples that an image forming job is executed in a state in which a single sheet is accommodated in the cassette 110*a* and a plurality of sheets which are the same type as the single sheet are accommodated in the cassette 110*b*. Specifically, after an image for a first page is formed on the sheet accommodated in the cassette 110*a*, the auto cassette change is performed so that a sheet is fed from the cassette 110*b* which accommodates the sheets which are the same type as the sheet of the cassette 110*a* and an image for a second page is formed on the sheet fed from the cassette 110*b*.

FIG. 3A is a timing chart of an operation of a general example, and FIG. 3B is a timing chart of an operation of this embodiment. Note that distances from the cassettes 110*a* and 110*b* to the secondary transfer roller 106 are short as described above, and therefore, image formation is performed by the "image-forming-first method".

The timing charts of FIGS. 3A and 3B illustrate the relationship among the sheet feeding motors 626*a* and 626*b*, the exposure controllers 103, the secondary transfer roller 106, and the sheet discharge sensor 140. The timing charts of FIGS. 3A and 3B further illustrate commands transmitted and received between the CPU 611 of the image processor 610 and the CPU 621 of the image forming unit 620.

First, the general example is described with reference to FIG. 3A. When receiving an image forming job (a print job), the CPU 611 transmits a print start command to the CPU 621 through the communication I/F 616 so as to start the job. The CPU 621 receives the print start command through the communication I/F 624 and starts a preparation operation for image forming operations including stable rotation of the photoconductive drums 102 and turning ON of high voltage of the charging/developing/primary transfer unit 160.

Subsequently, the CPU 611 transmits a page information command (1) including page information of a first page to the CPU 621. The page information includes, in this embodiment, a page number and an identification number of a cassette (a cassette number) which supplies a sheet. The page information may further include information on a sheet size and a sheet type. The CPU 621 which has received the page information command transmits an image formation start command (P1) to the CPU 611 when the preparation operation is terminated and start of the image forming operation is available. When the CPU 611 receives the image formation start command (P1), image data for the first page read from the image memory 615 is transmitted to the image forming unit 620 through the image signal I/Fs 617 and 650.

When receiving the image data for the first page, the exposure controllers 103 convert the received image data into laser driving signals and start laser exposure (S1311). The exposure controllers 103 stop the laser exposure when a period of time corresponding to a page size has elapsed (S1312).

Thereafter, the image forming controller 630 causes the charging/developing/primary transfer unit 160 to develop electrostatic latent images formed on the photoconductive drums 102 using a developing agent, and thereafter, primarily transfer a toner image onto the ITB 104.

Then the load driving unit 625 drives the sheet feeding motor 626*a* of the cassette 110*a* at a timing when the toner image on the ITB 104 is transferred on the sheet by the secondary transfer roller 106 (S1111). When driving of the sheet feeding motor 626*a* is started, the CPU 621 transmits a sheet feeding start command (P1) indicating that sheet feeding of the first sheet (a sheet on which the image for the first page is to be formed) is started to the CPU 611. When the sheet feeding of the first sheet is completed, the load driving unit 625 stops driving of the sheet feeding motor 626*a* (S1112). When the driving of the sheet feeding motor 626*a* is stopped, the sheet sensor 131*a* determines whether a sheet is detected in the cassette 110*a*.

The transfer controller 635 instructs the secondary transfer roller 106 to perform secondary transfer. The transfer controller 635 applies transfer high voltage for image formation at a timing when a toner image and the sheet overlap with each other so that the toner image is transferred onto the sheet (S1411). When a period of time corresponding to a page size has elapsed, the transfer controller 635 turns off the transfer high voltage (S1412). Thereafter, the fixing unit 107 fixes the toner on the sheet. The sheet is discharged to the finisher 500, a leading end of the sheet reaches the sheet discharge sensor 140 (S1511), a trailing end of the sheet has passed the sheet discharge sensor 140, and thereafter, the sheet is discharged from the finisher 500 (S1512). When the trailing end of the sheet has passed the sheet discharge sensor 140, the CPU 621 transmits a page completion command (P1) indicating that the process for the first page (a page process) is completed to the CPU 611. When receiving the page completion command (P1), the CPU 611 recognizes that the image forming operation for the first page is appropriately completed.

Next, an image forming operation for a second page will be described. When receiving the sheet feeding start command (P1) for the first page, the CPU 611 transmits page information command (P2) including page information of the second page (including a page number and a cassette identification number) to the CPU 621.

Here, if a sheet on which an image for the second page is to be formed is accommodated in the cassette 110*a*, the CPU 621 transmits a page completion command (P2) for the second page to the CPU 611 after the process is performed on the second page similarly to the first page.

However, in the examples of FIGS. 3A and 3B, only one sheet is accommodated in the cassette 110*a*. Therefore, the sheet on which the image for the second page is to be formed is supplied from the cassette 110*b* instead of the cassette 110*a*. However, the image forming apparatus 10 operates in the image-forming-first method, the exposure operation for the image data for the second page has been started by the exposure controllers 103 when it is determined that the cassette 110*a* does not accommodate any sheet. Accordingly, the image for the second page preferentially formed is subjected to development and first transfer, and thereafter, collected by the ITB cleaning unit 108, and an exposure operation for the second page is started again.

After the exposure is started based on the image data for the second page (S1321), it is determined that the cassette 110*a* does not accommodate any sheet (S1112). However, a toner image for the second page is conveyed to the secondary transfer roller 106 through the ITB 104. The Off state of the transfer high voltage of the secondary transfer roller 106 remains so that the secondary transfer roller 106 is prevented from being contaminated by the toner image (in a period from 51421 to S1422). However, even though the transfer high voltage is brought into the Off state, the toner is attached to the secondary transfer roller 106 (the secondary transfer outer roller). Therefore, the transfer controller 635 performs the cleaning process on the secondary transfer roller 106 (the secondary transfer outer roller) (S1423). In this cleaning process, an electric field for performing the cleaning on the secondary transfer roller 106 is formed, and specifically, the secondary transfer cleaning biases (DC plus and DC minus) are alternately applied to the secondary transfer roller 106 (the secondary transfer outer roller). In this way, the toner attached to the secondary transfer roller 106 is transferred to the ITB 104 and collected by the ITB cleaning unit 108.

After the cleaning on the secondary transfer roller 106 is terminated, the sheet for the first page which is a preceding page is discharged (S1511). After the discharge of the sheet for the first page is completed (S1512), the CPU 621 transmits a page completion command (P2, no-sheet) indicating that the page processing for the second page is terminated since no sheet is detected to the CPU 611. Note that a page completion command (P2, no-sheet) is transmitted after a page completion command (P1) is transmitted in the general example instead of when no-sheet is detected. This is because the process performed by the CPU 611 is simplified.

When receiving the page completion command (P2, no-sheet), the CPU 611 determines whether a sheet which is the same type as the sheet accommodated in the cassette 110*a* is accommodated in the other cassettes 110*b* to 110*d*. In the example of FIG. 3A, the same type of sheet is accommodated in the cassette 110*b*. Therefore, the CPU 611 determines that the auto cassette change is available. Then the CPU 611 performs reproduction of the image data and switching to the cassette 110*b* and transmits a page information command (P2, recovery) including page information for the second page to the CPU 621 so that the image formation for the second page is performed again. The page information command (P2, recovery) includes information for specifying the cassette 110*b* instead of the cassette 110*a*. Thereafter, the process the same as the normal print is performed on the second page.

Next, an operation of the auto cassette change of this embodiment will be described with reference to FIG. 3B. A process in step S2111 and step S2112 of FIG. 3B is the same as the process in step S1111 and step S1112 of FIG. 3A. Furthermore, a process in step S2311 and step S2312 of FIG. 3B is the same as the process in step S1311 and step S1312 of FIG. 3A. A process in step S2321 and step S2322 of FIG. 3B is the same as the process in step S1321 and step S1322 of FIG. 3A. A process in step S2411 and step S2412 of FIG. 3B is the same as the process in step S1411 and step S1412 of FIG. 3A.

FIGS. 3A and 3B are different from each other mainly in a timing when the page completion command (P2, no-sheet) is transmitted. In general, the page completion command (P2, no-sheet) is transmitted after the sheet on which the image for the first page is formed is discharged (S1512) (refer to FIG. 3A). On the other hand, in this embodiment, the page completion command (P2, no-sheet) is transmitted when no-sheet is determined in step S2112. This point is different from the general example.

Specifically, when the sheet feeding of the first sheet is terminated in step S2112 and the driving of the sheet feeding motor 626*a* is stopped, the sheet sensor 131*a* determines whether a sheet is detected in the cassette 110*a*. When determining that the cassette 110*a* does not accommodate any sheet in accordance with a detection signal supplied from the sheet sensor 131*a*, the CPU 621 transmits the page completion command (P2, no-sheet) to the CPU 611 in accordance with the determination result. When receiving the page completion command (P2, no-sheet), the CPU 611 determines whether a sheet which is the same type as the sheet accommodated in the cassette 110*a* is accommodated in the other cassettes 110*b* to 110*d*. In the example of FIG. 3B, as with the example of FIG. 3A, the same type of sheet is accommodated in the cassette 110*b*. Therefore, the CPU 611 determines that the auto cassette change is available. Then the CPU 611 performs reproduction of the image data and switching to the cassette 110*b* and transmits a page information command (P2, recovery) including page information for the second page to the CPU 621 so that the image formation for the second page is performed again. When FIG. 3A is compared with FIG. 3B, a transmission timing of the page information command (P2, recovery) in this embodiment is earlier than that of the general example.

After the page information command (P2, recovery) is received, the exposure controllers 103 wait for a period of time corresponding to the cleaning of the secondary transfer roller 106. The exposure controllers 103 wait for the period corresponding to the cleaning of the secondary transfer roller 106 so that a toner image of a restart page is prevented from reaching the secondary transfer roller 106 during the cleaning of the secondary transfer roller 106. The cleaning time of the secondary transfer roller 106 is approximately 600 msec in this embodiment although depending on a sheet size or the like. The cleaning time is at least longer than a sheet interval at a time of a normal transfer operation. The CPU 621 transmits an image formation start command (P2) to the CPU 611. When receiving the image formation start command (P2, recovery), the image processor 610 transmits image data to the image forming unit 620. Then the exposure controllers 103 wait for the cleaning time (a predetermined period of time) of the secondary transfer roller 106, and thereafter, start laser exposure corresponding to the image data for the second page which is the restart page (a recovery page) (S2331). Thereafter, the process the same as the normal print is performed.

When the general example (FIG. 3A) and this embodiment (FIG. 3B) are compared with each other, a period of time required for performing switching from the cassette 110*a* to the cassette 110*b* is reduced in this embodiment.

Flowcharts of Operations of CPU 611 and CPU 621

Figure 4:
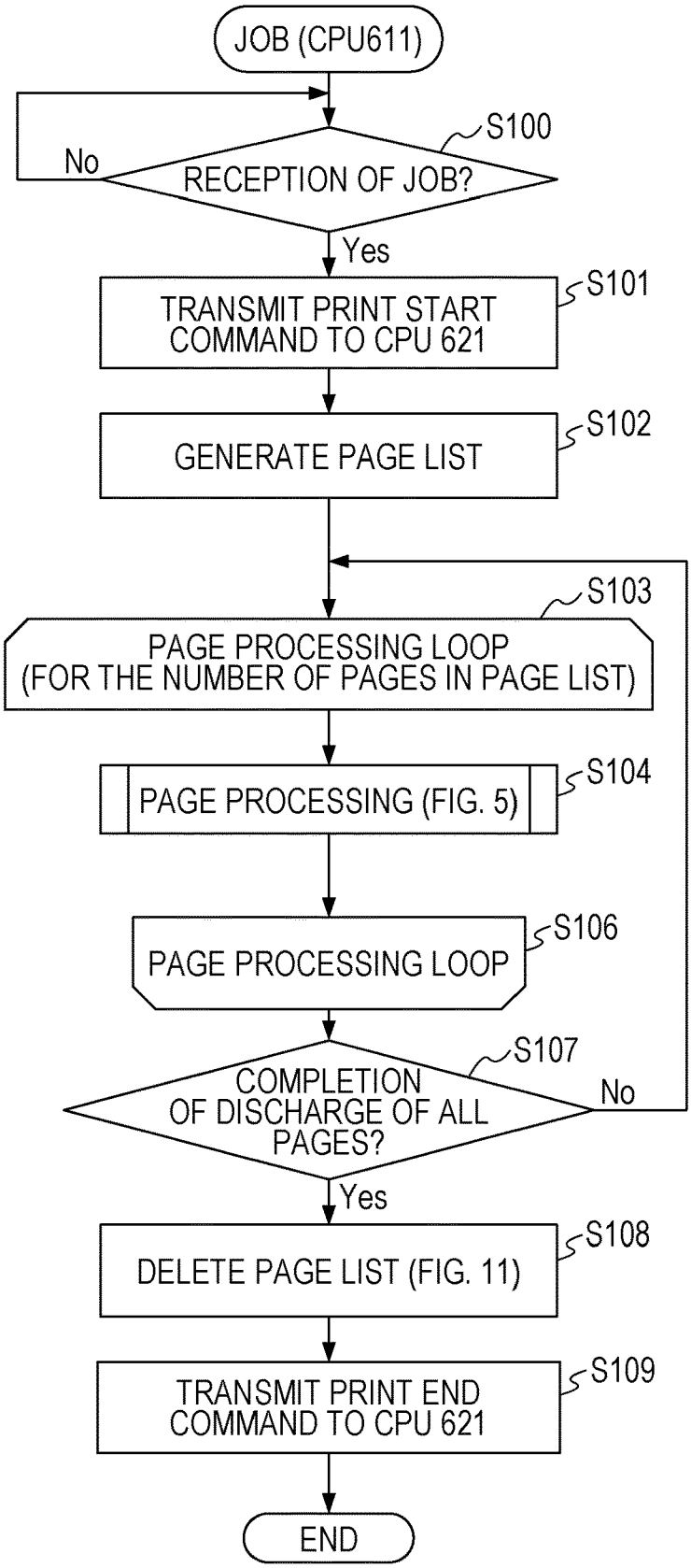
FIG. 4 is a flowchart of an operation performed when an image forming job is received.

FIGS. 4 and 5 are flowcharts of an operation performed by the CPU 611 of the image processor 610. Steps in the flowchart of FIG. 4 are performed when the CPU 611 reads and executes programs stored in the ROM 612.

First, the CPU 611 waits for a reception of a job from the operation unit 20 or an external apparatus not illustrated (No in S100 of FIG. 4). In this embodiment, the term "job" means an image forming job for performing image formation, that is, copy or network print, for example.

When the job is received (Yes in S100), the CPU 611 transmits a print start command to the CPU 621 so as to notify the CPU 621 of start of the job (S101). Subsequently, the CPU 611 generates a page list illustrated in FIG. 10 in accordance with content of the received job (S102). FIG. 10 is a diagram illustrating an example of the page list. As illustrated in FIG. 10, information on a page number, a page processing state, and a cassette number is set in the page list. A page number for identifying each page is assigned to the information on a page number. When the job illustrated in FIGS. 3A and 3B is received, 1 and 2 are assigned as page numbers.

As the information on a page processing state of FIG. 10, information indicating a processing state of each page is set and the information is updated in real time in accordance with a processing state of the image forming operation. Specifically, first, when the page list is generated, information "not generated" indicating that image data to be output to the image forming unit 620 has not been generated is stored. The information "not generated" indicates a state in which generation of image data has not been completed and a page information command has not been transmitted to the CPU 621. Subsequently, when the image data is generated and the page information command is transmitted to the CPU 621, the page processing state is updated from "not generated" to "generated". Thereafter, when a sheet is supplied from a cassette and a sheet feeding start command is supplied from the CPU 621, the page processing state is updated from "generated" to "completion of sheet feeding". Thereafter, image formation of a target page is completed, the CPU 611 receives a page completion command from the CPU 621. At this timing, the page processing state is updated from "sheet feeding completion" to "completion".

Information on cassettes which supply sheets on which images of pages are formed is set and stored in the information on a cassette number. In this embodiment, identification information for identifying one of the cassettes 110*a* to 110*d* is set in the information on a cassette number. When a job for performing image formation on a sheet supplied from the cassette 110*a* is received, for example, "a" indicating the cassette 110*a* is set in the information on a cassette number.

Furthermore, information "nothing" may be set. In this case, the sheet sensors 131 have detected no-sheet and no cassette accommodates the same type of sheet. When the information "nothing" is set in the information on a cassette number, any cassette may not be a target of the auto cassette change at a time of occurrence of no-sheet. In this case, the image forming apparatus 10 temporarily stops the image forming operation until sheets are additionally supplied by the user.

A description will be made again with reference to FIG. 4. After the page list (FIG. 10) is generated in step S102, the CPU 611 repeatedly performs the page processing described below and update of the page list a number of times corresponding to the number of pages described in the page list in step S103 to step S106.

In step S104, the CPU 611 performs various processes including transfer of image data and transmission and reception of various commands with the CPU 621 so as to execute the image forming operation on a target page (S104). The various processes performed on the target page is referred to as the "page processing" in this embodiment. Although the page processing will be described below in detail, when the page processing is executed, the CPU 611 updates the page processing state in the page list in step S104 (S104).

After the page processing is performed a number of times corresponding to the number of pages in the page list, the CPU 611 determines whether discharge of sheets for all pages is completed (S107). Specifically, the CPU 611 refers to the page list, and when page processing states of all the pages are "completed", the CPU 611 determines that discharge of all the pages is completed.

When the determination is negative in step S107 (No in S107), the process from step S103 to step S106 is performed again. When the determination is affirmative (Yes in S107), the CPU 611 determines an end of the image forming job, deletes the page list illustrated in FIG. 10 (S108), and transmits a print end command to the CPU 621 (S109). When the print end command is transmitted to the CPU 621, the job is completed.

Page Processing

Figure 5A:
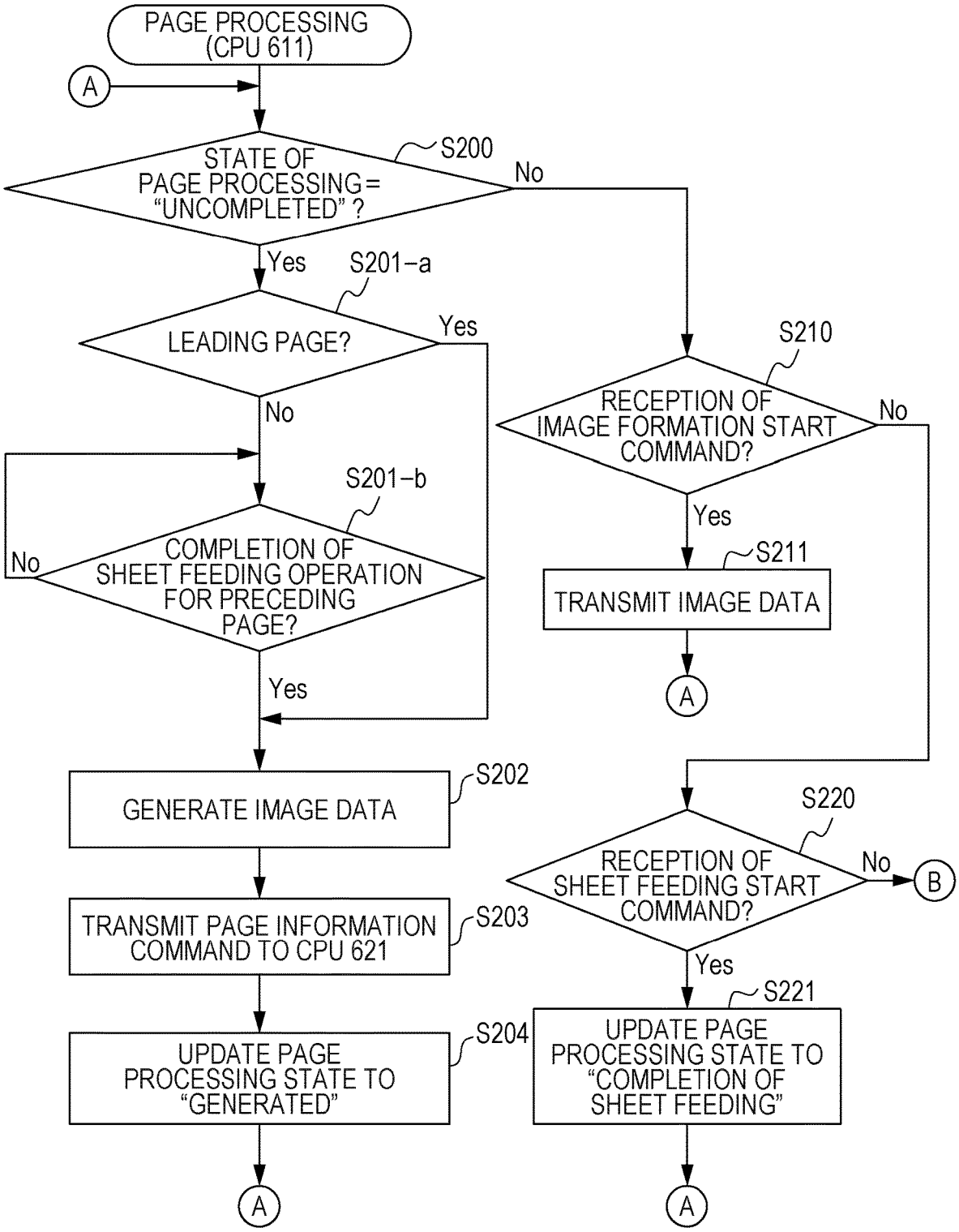
FIGS. 5A and 5B are a flowchart of page processing performed by a CPU 611.
Figure 5B:
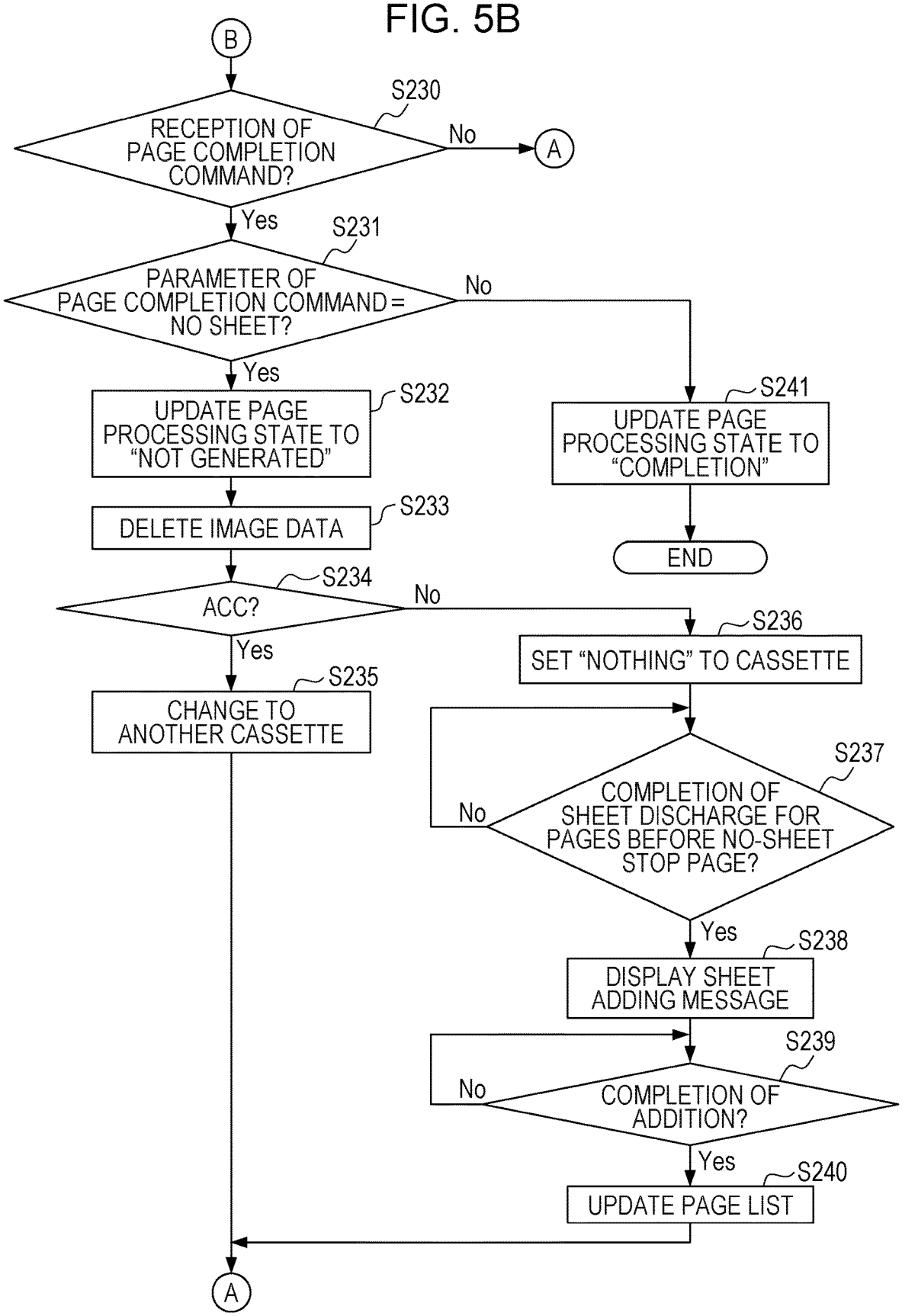

FIGS. 5A and 5B are a flowchart of the page processing which illustrates a process in step S104 in detail. This flowchart is executed for each page of the image forming job.

First, the CPU 611 determines whether a page processing state of a target page is "not generated" (S200). When the determination is affirmative in step S200, the process proceeds to step S201-*a*, and otherwise, the process proceeds to step S210.

In step S201-*a*, the CPU 611 determines whether the target page is a leading page, that is, a first page. When the determination is affirmative (Yes in S201-*a*), the process proceeds to step S202, whereas when the determination is negative (No in S201-*a*), the process proceeds to step S201-*b*. The CPU 621 determines whether a sheet feeding operation on a preceding page is completed. Specifically, the CPU 621 determines whether a page processing state corresponding to a page number immediately before the target page in the page list of FIG. 10 is "sheet feeding completion" or "completion". In other words, the CPU 621 determines whether a sheet feeding start command for the preceding page has been received. When the determination is affirmative (Yes in S201-*b*), the CPU 611 generates image data to be transmitted to the image forming unit 620 (S202). The generated image data is stored in the image memory 615. Subsequently, the CPU 611 transmits a page information command including information on a page number, a cassette number, a page size, and the like to the CPU 621 (S203), and updates the page processing state of the page list of FIG. 10 from "not generated" to "generated" (S204). When the determination is negative (No in S201-*b*), the CPU 611 waits for a reception of a sheet feeding start command of the preceding page of the target page which is supplied from the CPU 621, terminates the sheet feeding page process, and returns to step S200 so that next page processing is to be performed. Note that the page processing state of the preceding page of "sheet feeding completion" or "completion" is waited so that a process on a second page onwards is not simultaneously performed but the page processing progresses in accordance with the process performed by the CPU 621.

Subsequently, the CPU 611 determines whether an image formation start command has been received from the CPU 621 in step S210. When the determination is affirmative (Yes in S210), the CPU 611 reads the image data generated in step S202 from the image memory 615 and transmits the image data to the image forming unit 620 through the image signal I/F 617 (S211). When the determination is negative (No in S210), the CPU 611 determines whether a sheet feeding start command has been received from the CPU 621 (S220). When the determination is affirmative (Yes in S220), the CPU 611 updates the page processing state of the page list illustrated in FIG. 10 from "generated" to "sheet feeding completion" (S221).

Here, as for order of transmission of the image formation start command and the sheet feeding start command performed by the CPU 621, the image formation start command is first transmitted in the case of "image-forming-first method" and the sheet feeding start command is transmitted first in the case of "sheet-feeding-first method".

Subsequently, the CPU 611 determines whether a page completion command has been received from the CPU 621 (S230). When the determination is affirmative (Yes in S230), the CPU 611 further determines whether a parameter included in the page completion command indicates "no sheet" or "normal". When the CPU 611 determines that the parameter included in the page completion command indicates "no sheet" (Yes in S231), the process proceeds to step S232, whereas when the CPU 611 determines that the parameter indicates "normal" (No in S231), the process proceeds to step S241.

First, a process performed when it is determined that the parameter of the page completion command indicates "no sheet" will be described in detail. The CPU 611 updates the page processing state of the page list in FIG. 10 to "not generated" in step S232. Then the image data generated in step S202 is deleted from the image memory 615 (S233). Thereafter, it is determined whether the same type of sheet is accommodated in another cassette so that it is determined whether the auto cassette change is available (S234). When the determination is affirmative (Yes in S234), a target cassette number in the page list is changed to the other cassette which accommodates a sheet (S235). In this embodiment, the cassette which accommodates a sheet which is the same type of the sheet accommodated in the used cassette is sequentially searched for starting from the cassette 110*a*. Then the cassette number is changed to that of the cassette which is found as a result of the searching. However, the changing method of this embodiment is merely an example, and search order may be changed or a next cassette may be set in advance.

When the auto cassette change is not available (No in S234), the cassette number in the page list is changed to "Nothing" (S236). Thereafter, the CPU 611 determines whether all pages before a page which is stopped due to no-sheet have been discharged (S237). When the determination is negative in step S237, discharge of all the pages before the stop is waited (No in S237). On the other hand, when the determination is affirmative (Yes in S237), the CPU 611 displays a message indicating that sheets are required to be additionally supplied to the cassette (S238) and waits until the user additionally supplies sheets (No in S239). When the additional supply of the sheet by the user is completed (Yes in S239), the CPU 611 changes a setting of a cassette corresponding to no-sheet from "nothing" to identification information of the cassette to which sheets are additionally supplied in the page list (S114).

On the other hand, when the parameter of the page completion command is "normal" (No in S231), the page processing state of the page list is updated to "completed" (S241). The process of this flowchart is thus terminated.

Concrete Example of Page List

Update of the page list described above will be described in detail with reference to FIG. 11 using the image forming job illustrated with reference to FIGS. 3A and 3B. In FIGS. 11A to 11I are snapshots obtained when the page list is generated and when a page state is updated by transmission/reception of a command between the CPU 611 and the CPU 621. FIGS. 11A to 11I are arranged in time series and an updated portion is denoted by bold. A job indicates print on two sheets in a state in which a single sheet is accommodated in the cassette 110*a* and a plurality of sheets which are the same type as the single sheet are accommodated in the cassette 110*b*.

FIG. 11A is a generated page list and two rows are generated for the print on two sheets. A number which uniquely determined by the CPU 611 is assigned to a page number, and a first page is denoted by "1" and a second page is denoted by "2". As a page processing state, an initial value is "not generated" is set, and as a cassette number, "a" (the cassette 110*a*) is set to both the two pages in accordance with an instruction issued by the operation unit 20.

FIG. 11B is the page list obtained when the page information command (P1) of the first page is transmitted from the CPU 611 to the CPU 621 (S203). As illustrated in FIG. 11B, when the page information command (P1) of the first page is transmitted from the CPU 611 to the CPU 621, the page processing state of the first page in the page list is updated from "not generated" to "generated".

FIG. 11C is the page list obtained when the sheet feeding start command (P1) of the first page is received by the CPU 611 from the CPU 621 (S221). As illustrated in FIG. 11C, when the sheet feeding start command (P1) is received, the page processing state of the first page is updated from "generated" to "sheet feeding completion".

FIG. 11D is the page list obtained when the page information command (P2) of the second page is transmitted from the CPU 611 to the CPU 621 (S203). As illustrated in FIG. 11D, when the page information command (P2) is transmitted, the page processing state of the second page is updated from "not generated" to "generated".

FIG. 11E is the page list obtained when the page completion command (P2, no-sheet) of the second page is received by the CPU 611 from the CPU 621. As illustrated in FIG. 11E, when the page completion command (P2, no-sheet) of the second page is received, the page processing state of the second page is updated from "generated" to "not generated". Furthermore, as a result of execution of the auto cassette change described with reference to FIGS. 3A and 3B, the cassette is updated from "a" to "b".

FIG. 11F is the page list obtained when the page information command (P2, recovery) of the second page is transmitted from the CPU 611 to the CPU 621. As illustrated in FIG. 11F, when the page information command of the second page is transmitted, the page processing state of the second page is updated from "not generated" to "generated".

FIG. 11G is the page list obtained when the sheet feeding start command (P2) of the second page is received by the CPU 611 from the CPU 621. As illustrated in FIG. 11G, when the sheet feeding start command (P2) of the second page is received, the page processing state of the second page is updated from "generated" to "sheet feeding completion".

FIG. 11H is the page list obtained immediately after the page completion command (P1) of the first page is received by the CPU 611 from the CPU 621. As illustrated in FIG. 11H, when the page completion command (P1) of the first page is received, the page processing state of the first page is updated from "sheet feeding completion" to "completion".

FIG. 11I is the page list obtained when the page completion command of the second page is received by the CPU 611 from the CPU 621. As illustrated in FIG. 11I, the page processing state of the second page is updated from "sheet feeding completion" to "completion". The process performed by the image processor 610 is described hereinabove.

Flowchart of CPU 621

Figure 6A:
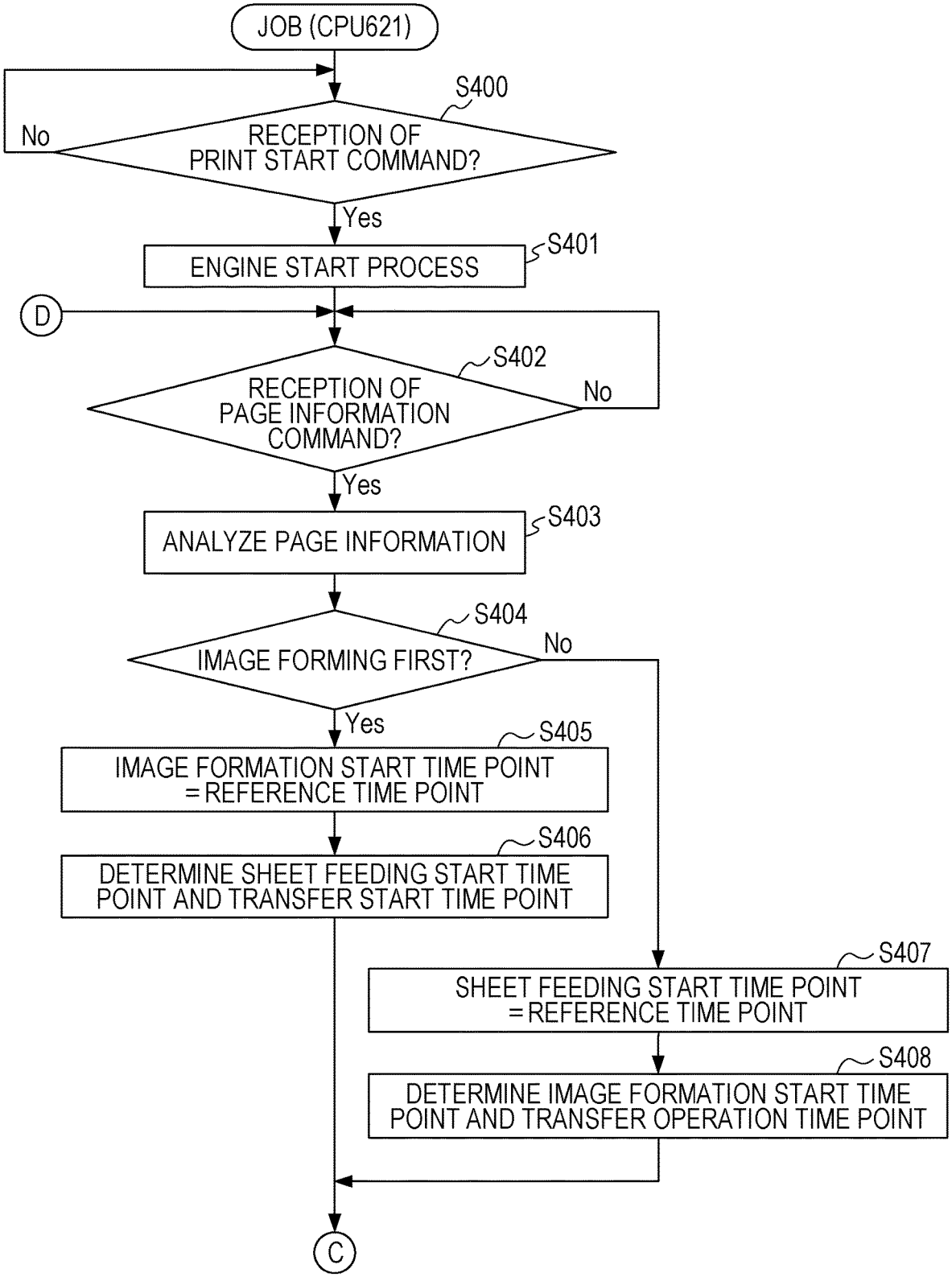
FIGS. 6A and 6B are a flowchart of an operation performed when a CPU 621 receives a print start command from the CPU 611.
Figure 6B:
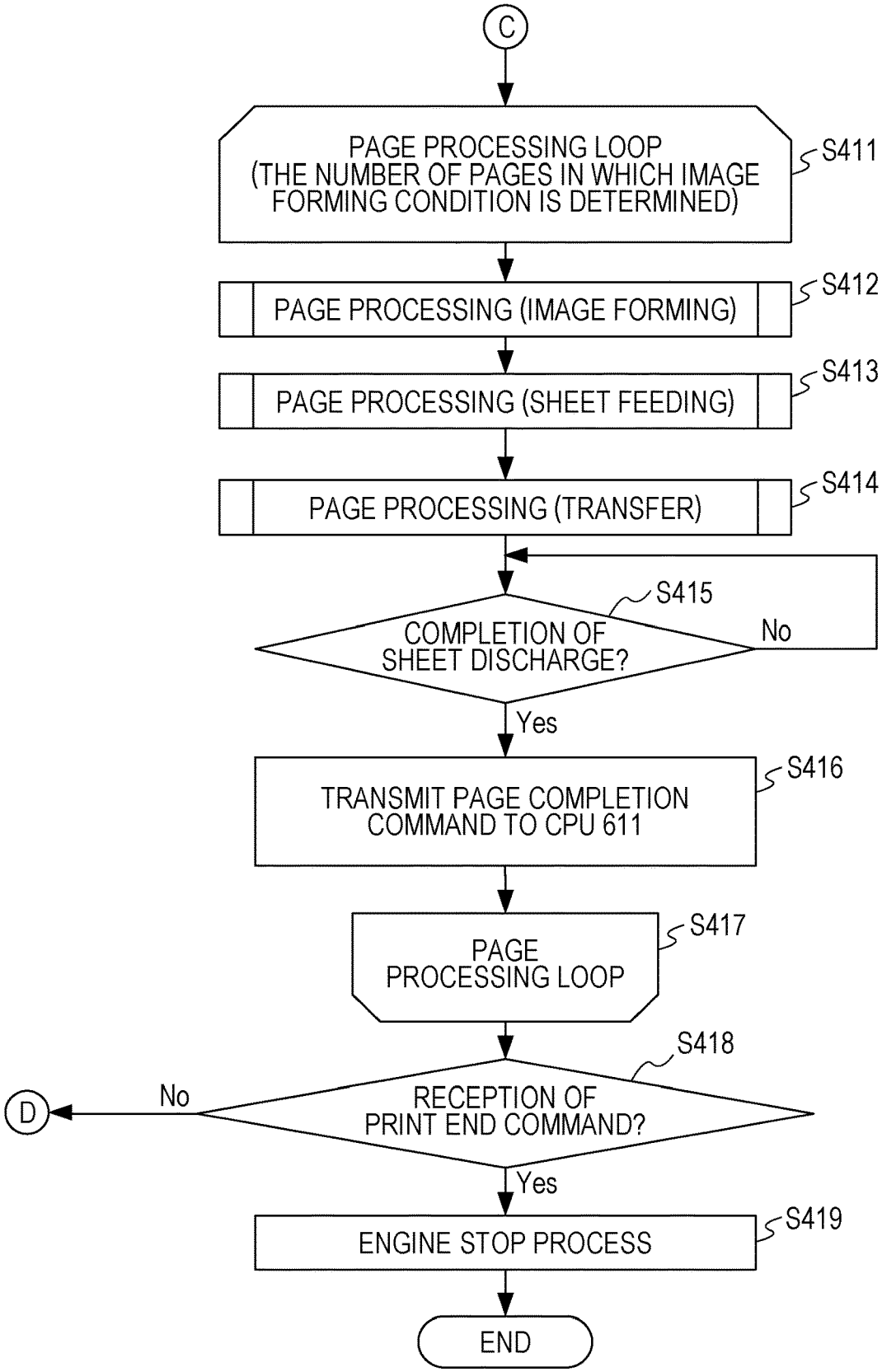

FIGS. 6A and 6B are a flowchart of a process executed by the CPU 621 according to this embodiment. Steps in the flowchart of FIGS. 6A and 6B are performed when the CPU 621 reads and executes programs stored in the ROM 622.

First, the CPU 621 waits for a reception of a page start command supplied from the CPU 611 (S400). When receiving the print start command (Yes in S400), the CPU 621 performs an engine start process (S401). The engine start process corresponds to preprocessing of the image forming controller 630 and includes processes required until the toner image formation is performed, such as stable rotation of loads, such as the ITB 104 and the photoconductive drums 102, and turning On of high voltage of the charging/developing/primary transfer unit 160, other than laser exposure.

When receiving a page information command from the CPU 611 (Yes in S402), the CPU 621 analyzes the page information command (S403). The page information command includes information on a page number, a cassette identification number, a sheet type, a sheet size, and the like, and the CPU 621 determines an image forming condition in step S405 to step S408 in accordance with a result of the analysis of the information. The CPU 621 determines an image forming condition for image formation, sheet feeding, and transfer. The image forming condition is used to determine start timings of an image forming operation, a sheet feeding operation, and a transfer operation, and defines the relationship among the three operations. The image forming condition determined here is referred to when the image forming operation (S412), the sheet feeding operation (S413), and the transfer operation (S414) are performed.

FIG. 12 is a diagram illustrating the image forming condition determined in step S405 to step S408. In an item of a page number in FIG. 12, a page number included in the page information command supplied from the CPU 611 is registered. In an item of a cassette, a cassette number included in the page information command supplied from the CPU 611 is registered. A reference time point is determined by productivity of the image forming apparatus 10 and is further determined by a page interval. A start time point of each of the operations is determined by adding an offset time to the reference time point. Specifically, a start time point of the image forming operation is offset by A time, a start time point of the sheet feeding operation is offset by B time, and a start time point of the transfer operation is offset by C time. Then the individual operations are executed in a period from the start time points to completion time points. The completion time points are obtained by offsetting the start time points by a time corresponding to a page size (a sheet size) in the page information command.

Subsequently, the CPU 621 determines whether to employ the image-forming-first method or the sheet-feeding-first method in accordance with the result of the analysis of the page information command (S404). Specifically, when the cassette 110*a* or the cassette 110*b* is used, it is determined the image-forming-first method is employed whereas when the cassette 110*c* or the cassette 110*d* is used, it is determined that the sheet-feeding-first method is employed. When it is determined that the image-forming-first method is employed (Yes in S404), the CPU 621 registers the reference time point as an image formation start time point (S405). Specifically, according to FIG. 12, when the image-forming-first method is employed, an offset A relative to the start time point of the image forming operation is 0. After the start time point of the image forming operation is registered in the image forming condition, the CPU 621 registers a time point obtained by adding a B time to the reference time as a start time point of the sheet feeding operation and further registers a time point obtained by adding a C time as a start time point of the transfer operation in step S406.

Furthermore, when it is determined that the sheet-feeding-first method is employed in step S404 (No in S404), the CPU 621 registers the reference time point as a sheet feeding start time point (S407). Specifically, according to FIG. 12, when the sheet-feeding-first method is employed, the offset B of the start time point of the sheet feeding operation is 0. After the start time point of the sheet feeding operation is registered, the CPU 621 registers the start time point of the image forming operation and the start time point of the transfer operation in step S408.

In step S411, the CPU 621 repeatedly performs page processing of the image forming operation (S412), page processing of the sheet feeding operation (S413), and page processing of the transfer operation (S414) a number of times corresponding to the number of pages in which the image forming condition is determined in step S403. Thereafter, when determining that a sheet of a target page has been discharged, the CPU 621 transmits a page completion command to the CPU 611 (S416).

When receiving a print end command from the CPU 611, the CPU 621 determines that the image forming job is terminated and performs an engine stop process (S419). The engine stop process includes turning off of the high voltage of the charging/developing/primary transfer unit 160 and stop of rotation of the loads, such as the ITB 104 and the photoconductive drums 102.

Page Processing of Exposure/Primary Transfer Operation

Figure 7:
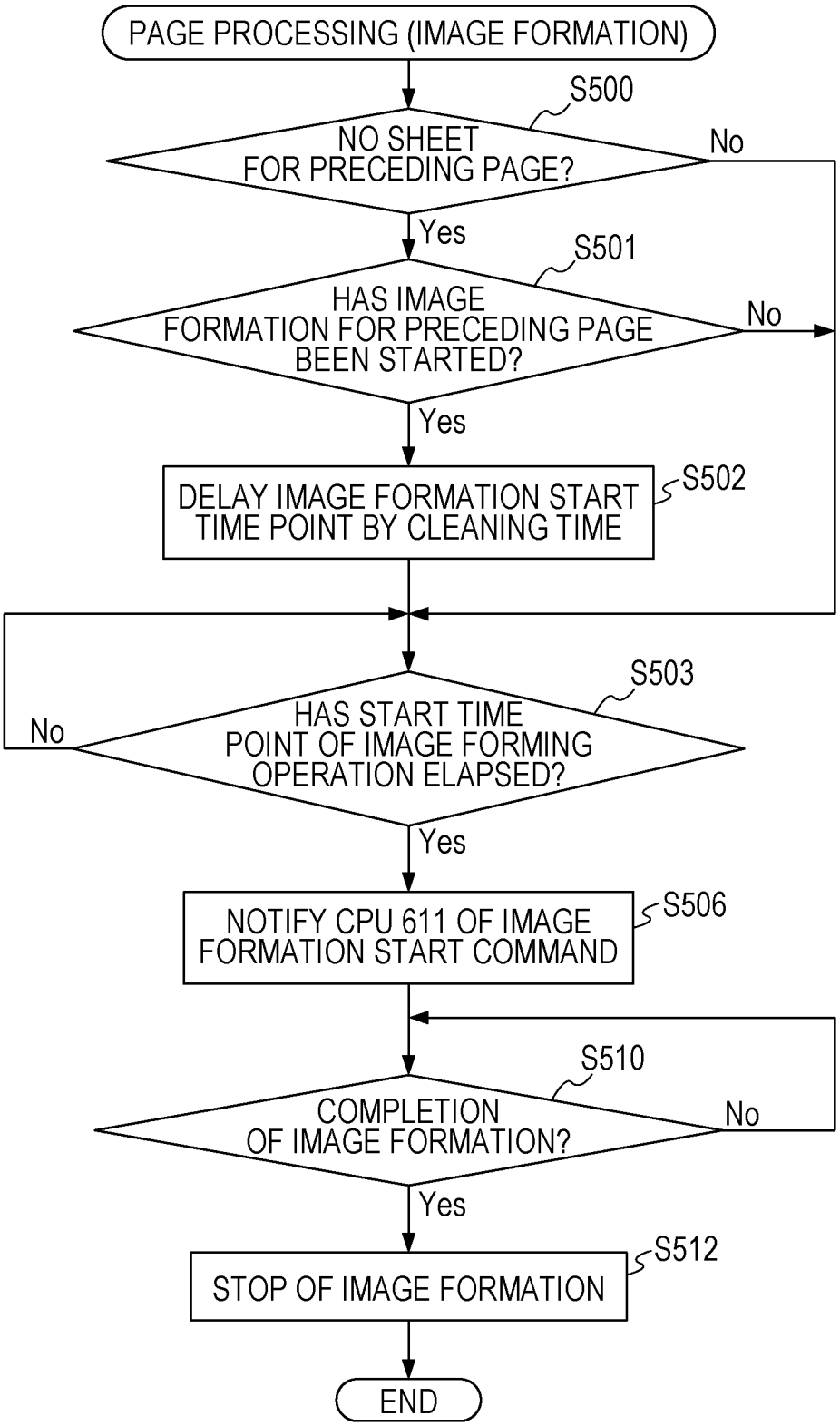
FIG. 7 is a flowchart of an image forming operation.

FIG. 7 is a flowchart of the image forming operation from the exposure to the primary transfer which illustrates the process in step S412 in detail.

First, in step S500, the CPU 621 determines whether a preceding page of a target page corresponds to no sheet. When the determination is affirmative in step S500, the CPU 621 determines whether image formation of the preceding page has been started in step S501. This determination is made since the exposure is to be delayed by a time of the cleaning process of the secondary transfer roller 106 if the image formation is started after it is determined that the preceding page corresponds to no sheet. When the determination is negative in step S500 or when the determination is negative in step S501, the cleaning of the secondary transfer roller 106 is not required to be waited, and therefore, the CPU 621 waits until the image formation start time point determined in step S406 (No in S503). Note that, in the case of the sheet-feeding-first method, the image formation is not started when no sheet is detected. Therefore, the case corresponds to a case where the preceding page of the target page corresponds to no-sheet (Yes in S500) and the image formation is not started on the preceding page of the target page (No in S501). When the image formation start time point has passed (Yes in S503), the CPU 621 transmits an image formation start command to the CPU 611 so as to start exposure (S506). Here, when the image formation start command is transmitted to the CPU 611, the image processor 610 which has received the image formation start command transmits image data. By this, laser exposure is started by the exposure controllers 103. Subsequently, the CPU 621 waits for completion of the image forming operation (No in S510). Here, the completion the image formation corresponds to a case where an image forming operation completion time point (FIG. 12) of the image forming condition determined in step S405 to step S408 has passed. When it is determined that the image forming operation is completed (Yes in S510), the image formation is stopped (S512) and the flowchart of FIG. 7 is terminated.

Next, when the preceding page of the target page corresponds to no-sheet (Yes in S500) and the image formation has been started on the preceding page (Yes in S501), cleaning control is required to be performed on the secondary transfer roller 106 before secondary transfer is performed on the target page. Therefore, the image formation start time point of the target page is delayed by the cleaning time (approximately 600 msec, for example) of the secondary transfer roller 106 from a trailing end of a toner image in the page corresponds to no-sheet (S502). Here, the cleaning on the secondary transfer roller 106 changes polarity of the high voltage of the secondary transfer roller 106 after the toner image of the page corresponding to no-sheet has passed the secondary transfer roller 106.

Since the method for transferring toner attached to the secondary transfer roller 106 onto the ITB 104 is employed in this embodiment, productivity is required to be degraded (a sheet interval is increased). However, if a period of time from the trailing end of the toner image of the preceding page to start of the image formation of the target page is longer than the cleaning time of the secondary transfer roller 106, the image formation start time point is not required to be delayed.

Page Processing of Sheet Feeding Operation

Figure 8:
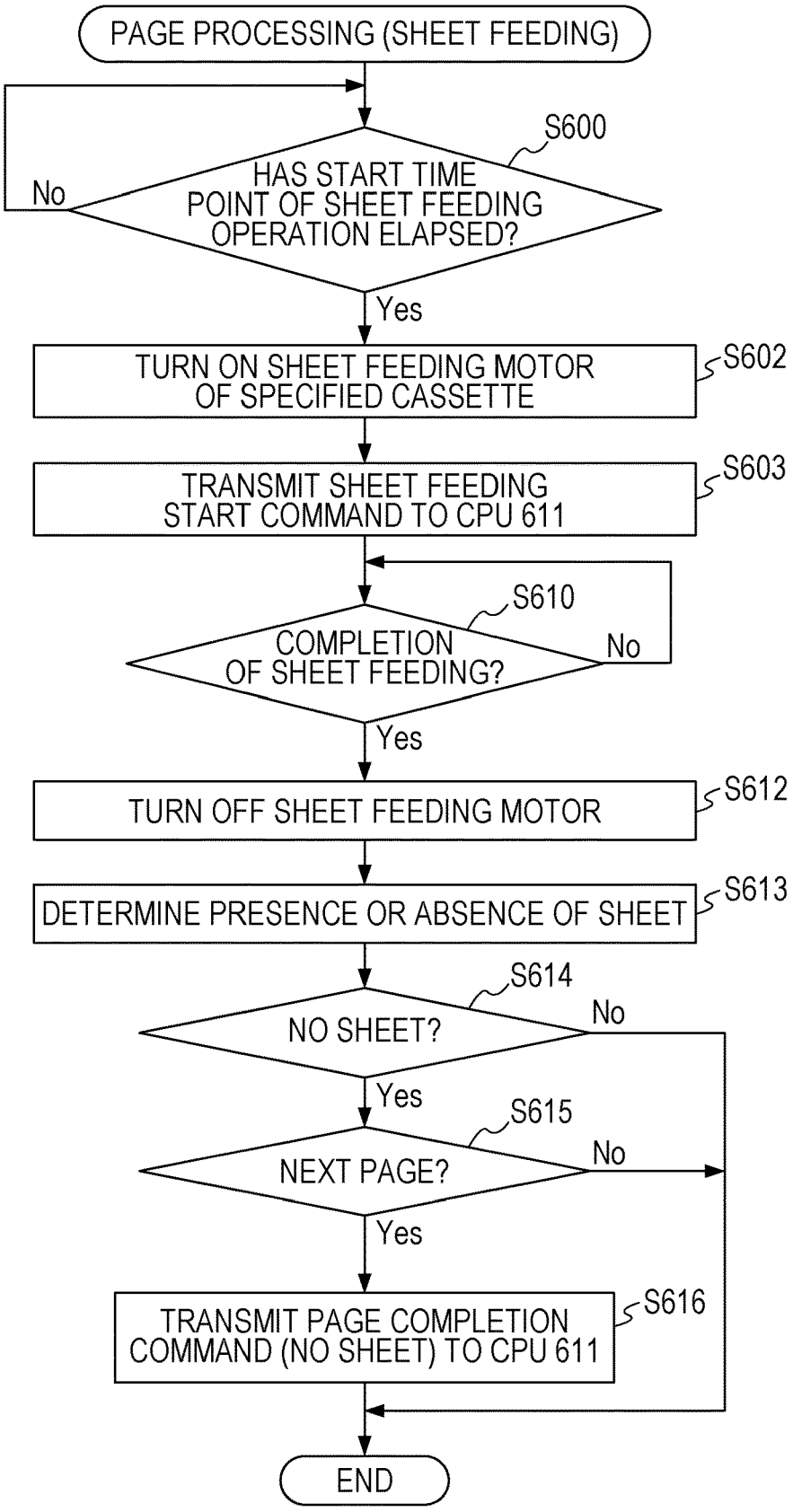
FIG. 8 is a flowchart of a sheet feeding operation.

FIG. 8 is a flowchart of the sheet feeding operation of feeding a sheet from a cassette which illustrates the process in step S413 in detail.

First, in step S600, the CPU 621 waits until the determined sheet feeding start time point. When the sheet feeding start time point is reached (Yes in S600), the load driving unit 625 starts driving of one of the sheet feeding motors 626*a* to 626*d* of the specified one of the cassettes 110*a* to 110*d* (S602) and the CPU 621 transmits a sheet feeding start command to the CPU 611 (S603). Here, the specified cassette is determined in step S406 (FIG. 12). When the sheet feeding is completed (Yes in S610), the load driving unit 625 stops driving of the sheet feeding motors 626*a* to 626*d* of the cassettes 110*a* to 110*d* (S612). Here, the completion of the sheet feeding indicates a time when a leading end of the sheet has passed one of the sheet feeding sensors 130*a* to 130*d*, and thereafter, a trailing end of the sheet has passed the one of the sheet feeding sensors 130*a* to 130*d*. Furthermore, a time point when the sheet feeding operation is completed which is determined in step S406 (FIG. 12) is merely a reference, and if a time point is considerably different from the reference time point, it may be determined that the sheet is stuck. Then the CPU 621 determines presence or absence of a sheet based on a detection signal supplied from the sheet sensors 131 (S613). Note that the determination of presence or absence of a sheet is made at this timing in this embodiment due to a mechanism in which the determination of presence or absence of a sheet may not be made during driving of a sheet feeding motor. However, the timing of the determination of presence or absence of a sheet is not limited to this.

When it is determined that the cassette accommodates a sheet as a result of the determination in step S613 (No in S614), the process of this flowchart is terminated. On the other hand, when it is determined that the cassette does not accommodate any sheet as a result of the determination in step S613 (Yes in S614), the CPU 621 determines whether a next page is to be processed (S615). If it is determined that the next page is to be processed, the processed page is not a last page of the image forming job. In this case (that is, a case where no-sheet is detected and a next page is detected), the auto cassette change is required to be performed so that the image forming operation is continued. Therefore, the CPU 621 transmits a page completion command (no-sheet) to the CPU 611 so as to notify the CPU 611 of information on no-sheet at this timing and terminates the process. In this embodiment, the page completion command indicating no-sheet is transmitted at this timing so that the image forming operation is restarted early. That is, the CPU 611 which has received the page completion command indicating no-sheet performs processes including regeneration of image data, a determination whether ACC is available, and switching to another cassette as illustrated in step S231 of FIG. 5B (S232 to S236). Since the page completion command is transmitted when all sheets are discharged in the general example, the process of ACC is delayed. However, since the page completion command is issued at the time of the determination of presence or absence of a sheet, a high-speed process is realized.

Page Processing of Transfer Operation

Figure 9:
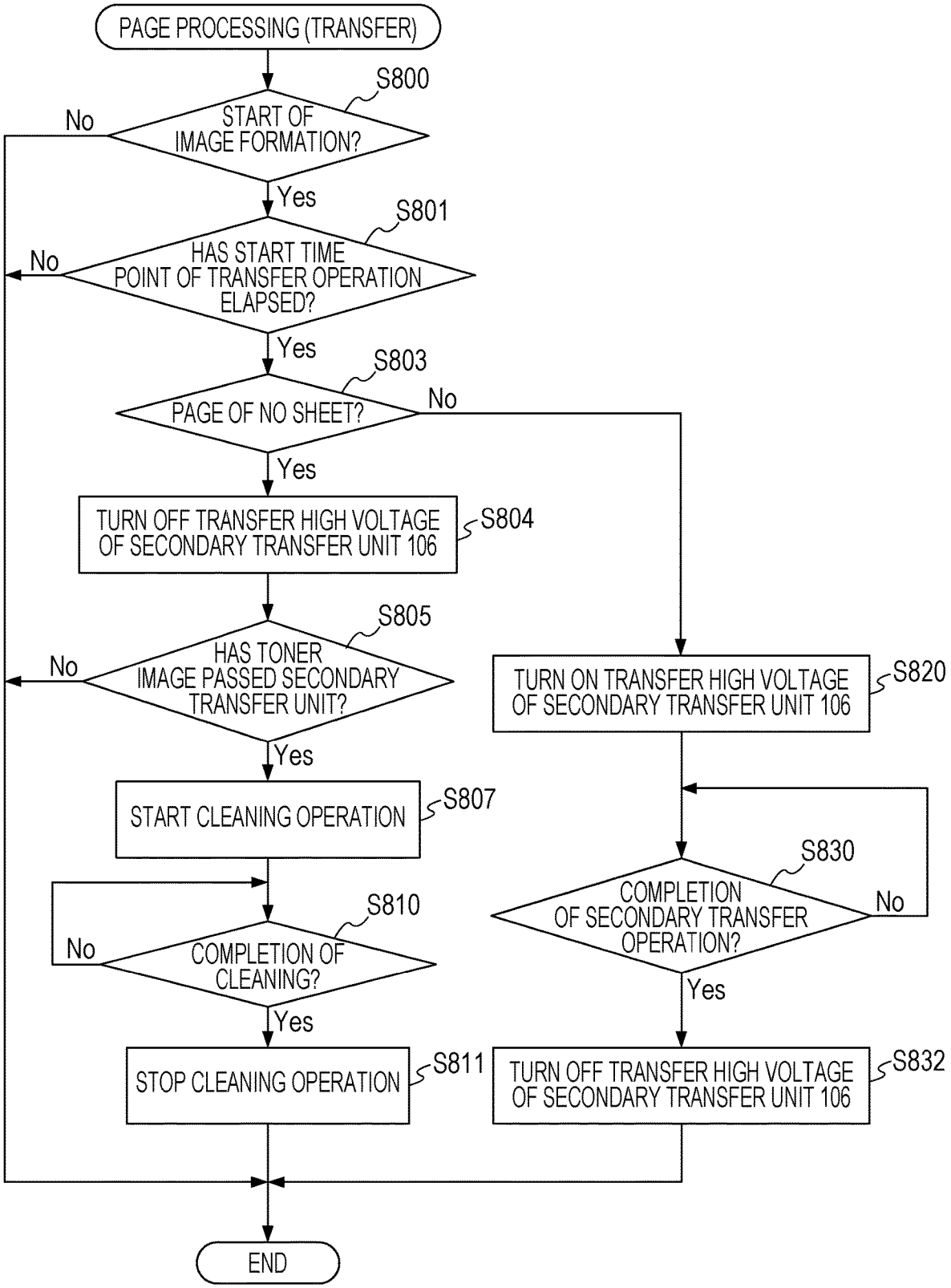
FIG. 9 is a flowchart of a transfer operation.

FIG. 9 is a flowchart of the secondary transfer operation of a toner image on the ITB 104 onto a sheet which illustrates the process in step S414 in detail.

In step S800, the CPU 621 waits until the image formation is started (No in S800). After the image formation is started (Yes in S800), the CPU 621 waits until a transfer start time point has elapsed (No in S801). The toner image on the ITB 104 is supplied to the secondary transfer roller 106 at the transfer start time point which is the transfer operation start time point determined in step S406. When the transfer start time point has elapsed (Yes in S801), the CPU 621 determines whether the target page corresponds to no-sheet. When the determination is negative (No in S803), the transfer high voltage of the secondary transfer roller 106 is turned on and the toner image on the ITB 104 is transferred onto the sheet (S820). Then the CPU 621 waits until the sheet has passed the secondary transfer roller 106 (No in S830). Here, a determination as to whether the sheet has passed the secondary transfer roller 106 corresponds to a determination as to whether the time point when the transfer operation is completed determined in step S406 (FIG. 12) has passed. After the sheet has passed the secondary transfer roller 106 (Yes in S830), the transfer high voltage of the secondary transfer roller 106 is turned Off (S832), and the process of the flowchart is terminated.

On the other hand, when the determination is affirmative (Yes in S803), the transfer high voltage of the secondary transfer roller 106 is turned Off (S804). Here, the transfer high voltage of the secondary transfer roller 106 is turned Off so that the toner is prevented from being attached to the secondary transfer roller 106. However, since the ITB 104 and the secondary transfer roller 106 are in contact with each other in a pressure manner, little toner is attached to the secondary transfer roller 106. The cleaning operation is required to remove such residual toners attached to the secondary transfer roller 106. Then pass of the toner image on the ITB 104 through the secondary transfer roller 106 is waited (No in S805). Here, a determination as to whether the sheet has passed the secondary transfer roller 106 corresponds to a determination as to whether the time point when the transfer operation is completed determined in step S406 (FIG. 12) has passed. After the toner image has passed the secondary transfer roller 106 (Yes in S805), the CPU 621 starts the cleaning (S807). In this cleaning operation, an operation of inversely biasing a high voltage of the secondary transfer roller 106 (minus 1000 V), waiting one rotation of the secondary transfer roller 106, normally biasing the high voltage (plus 1000 V), and waiting one rotation of the secondary transfer roller 106 is performed twice. After the cleaning of the secondary transfer roller 106 is started (S807), completion of the cleaning is waited (No in S810). The completion of the cleaning is reached after the operation of waiting the secondary transfer roller 106 by one rotation is performed twice. After the cleaning is completed (Yes in S810), the high voltage of the secondary transfer roller 106 is turned off so that the cleaning is stopped (S811).

As described above, the image forming apparatus of this embodiment may continue an image forming operation using ACC when information on no-sheet is detected and may perform early restart of the image forming operation on a page when information on no-sheet is detected after start of image formation.

Other Embodiments

The present invention may also be realized by executing processing below. Specifically, software (programs) which realizes the functions of the foregoing embodiment is supplied to a system or an apparatus through a network or various storage media and a computer (or a CPU, an MPU, or the like) of the system or the apparatus reads and executes a program code. In this case, the programs and the storage media which store the programs are also included in the present invention.

The present invention is not limited to the foregoing embodiment and various changes and modifications may be made without departing from the spirit and the scope of the present invention. Accordingly, the following claims are attached to disclose the scope of the present invention.

According to the present invention, when an image forming apparatus which performs auto cassette change determines that sheets are run out after image formation is started, the image forming apparatus may quickly restart an image forming operation on a page.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An image forming apparatus, comprising:

a first photoreceptor;

first exposure means configured to expose the first photoreceptor so as to form an electrostatic latent image on the first photoreceptor;

first developing means configured to develop the electrostatic latent image formed on the first photoreceptor as a toner image;

a second photoreceptor;

second exposure means configured to expose the second photoreceptor so as to form an electrostatic latent image on the second photoreceptor;

second developing means configured to develop the electrostatic latent image formed on the second photoreceptor as a toner image;

an intermediate transfer belt onto which the toner image formed on the first photoreceptor and the toner image formed on the second photoreceptor are transferred;

a secondary transfer roller configured to transfer the toner image on the intermediate transfer belt onto a sheet;

a plurality of sheet accommodation units configured to accommodate sheets;

detection means configured to detect a sheet and provided for individual sheet accommodation units; and control means configured to continue an image forming job by performing switching to a second sheet accommodation unit which accommodates sheets which are the same as a specified type of sheet accommodated in a first sheet accommodation unit, which is one of the sheet accommodation units, when it is determined that the first sheet accommodation unit does not accommodate a sheet in accordance with a signal supplied from the detection means provided for the first sheet accommodation unit while the image forming job of forming an image on a sheet supplied from the first sheet accommodation unit is executed, wherein the first photoreceptor is disposed on an upstream side relative to the second photoreceptor in a direction of rotation of the intermediate transfer belt, and the control means executes a cleaning process of forming an electric field for cleaning between the intermediate transfer belt and the secondary transfer roller when determining that a sheet to which a toner image of image data is to be transferred is not accommodated in the first sheet accommodation unit after formation of an electrostatic latent image of data in a certain page is started by the first exposure means, and causes the first exposure means to form the electrostatic latent image of the image data on the same page before the cleaning process is terminated.

2. The image forming apparatus according to claim 1, wherein the electric field for the cleaning is formed by applying a transfer voltage having a reversed polarity relative to a transfer voltage obtained when the toner image is transferred onto the sheet.

3. The image forming apparatus according to claim 1, further comprising:

a cleaning unit configured to collect toner on the intermediate transfer belt, wherein the toner attached to the secondary transfer roller is collected by the cleaning unit by applying a transfer voltage for the cleaning to the secondary transfer roller.

4. The image forming apparatus according to claim 1, wherein the control means causes the exposure means to form an electrostatic latent image of image data in the same page when a predetermined period of time has elapsed after determining that the first sheet accommodation unit does not have a sheet.

5. The image forming apparatus according to claim 4, wherein the predetermined period of time is determined based on a period of time required for the cleaning process.

6. The image forming apparatus according to claim 1, further comprising:

fixing means configured to fix a toner image transferred to a sheet by the secondary transfer roller on the sheet; and discharge means configured to discharge the sheet which has passed the fixing means.

7. The image forming apparatus according to claim 1, wherein the period of time required for the cleaning process is longer than an interval between sheets which have passed the second transfer roller.

8. The image forming apparatus according to claim 1, wherein the detection means detects presence or absence of a sheet when a sheet is fed from the sheet accommodation unit.

9. The image forming apparatus according to claim 1, wherein the control means includes first control means, and second control means, the second control means transmits a command indicating no-sheet to the first control means when it is determined that the first sheet accommodation unit does not accommodate a sheet, and the first control means which has received the command searches for a sheet accommodation unit which accommodates a sheet which is the same type as the first sheet accommodation unit.

* * * * *